US010071416B2

(12) United States Patent
Williams et al.

(10) Patent No.: US 10,071,416 B2
(45) Date of Patent: Sep. 11, 2018

(54) HIGH STRENGTH THIN CAST STRIP PRODUCT AND METHOD FOR MAKING THE SAME

(75) Inventors: James Geoffrey Williams, Balgownie (AU); Harold Roland Kaul, Mt. Ousley (AU); Daniel Geoffrey Edelman, Brownsburg, IN (US); Christopher Ronald Killmore, Wollongong (AU)

(73) Assignee: Nucor Corporation, Charlotte, NC (US)

( * ) Notice: Subject to any disclaimer, the term of this patent is extended or adjusted under 35 U.S.C. 154(b) by 826 days.

(21) Appl. No.: 12/709,133

(22) Filed: Feb. 19, 2010

(65) Prior Publication Data

US 2010/0186856 A1 Jul. 29, 2010

Related U.S. Application Data

(63) Continuation-in-part of application No. 12/116,039, filed on May 6, 2008, and a continuation-in-part of
(Continued)

(51) Int. Cl.
*B22D 11/00* (2006.01)
*B22D 11/06* (2006.01)
(Continued)

(52) U.S. Cl.
CPC ..... *B22D 11/001* (2013.01); *B22D 11/0622* (2013.01); *B22D 11/117* (2013.01);
(Continued)

(58) Field of Classification Search
CPC .... C21D 1/18; C21D 7/13; C21D 6/02; C22C 38/46; C22C 38/48; B22D 11/001
(Continued)

(56) References Cited

U.S. PATENT DOCUMENTS 4,067,754 A 1/1978 Elias et al.
4,073,643 A 2/1978 Kumai et al.
(Continued)

FOREIGN PATENT DOCUMENTS

AT 313402 1/2006
AU 744196 2/2002
(Continued)

OTHER PUBLICATIONS

Bhadeshia, H.K.D.H., 'Bainite in Steels' 2nd edition, Chapter 13: Modern Baintic Steels, pp. 343-347, published by the Institute of Materials, Minerals and Mining, Mar. 2001.
(Continued)

*Primary Examiner* — Weiping Zhu
(74) *Attorney, Agent, or Firm* — Hahn Loeser & Parks LLP

(57) ABSTRACT

A steel product or thin steel cast strip including, by weight, less than 0.25% carbon, between 0.20 and 2.0% manganese, between 0.05 and 0.50% silicon, less than 0.01% aluminum, and at least one of niobium between 0.01% and 0.20% and vanadium between 0.01% and 0.20%, and a microstructure of a majority bainite and acicular ferrite, and more than 70% niobium and/or vanadium in solid solution. The steel product may have an increase in elongation and an increase in yield strength after age hardening. The age hardened steel product may have niobium carbonitride particles with an average particle size of 10 nanometers and less, and may have substantially no niobium carbonitride particles greater than 50 nanometers. The steel product may have a yield strength of at least 380 MPa, a tensile strength of at least 410 MPa, or both. The product may have a total elongation of at least 6% or 10%.

42 Claims, 20 Drawing Sheets

Related U.S. Application Data application No. 11/744,881, filed on May 6, 2007, and a continuation-in-part of application No. 11/255,604, filed on Oct. 20, 2005, now Pat. No. 7,485,196.

(60) Provisional application No. 61/154,231, filed on Feb. 20, 2009, provisional application No. 60/943,781, filed on Jun. 13, 2007.

(51) Int. Cl.

| | |
|---|---|
| ***B22D 11/117*** | (2006.01) |
| ***C21D 6/02*** | (2006.01) |
| ***C21D 8/02*** | (2006.01) |
| ***C22C 38/02*** | (2006.01) |
| ***C22C 38/04*** | (2006.01) |
| ***C22C 38/12*** | (2006.01) |

(52) U.S. Cl.

CPC ..... *C21D 6/02* (2013.01); *C21D 8/0215* (2013.01); *C22C 38/02* (2013.01); *C22C 38/04* (2013.01); *C22C 38/12* (2013.01); *C21D 2211/002* (2013.01); *C21D 2211/004* (2013.01); *C21D 2211/005* (2013.01)

(58) Field of Classification Search

USPC ..... 148/320, 541

See application file for complete search history.

(56) References Cited

U.S. PATENT DOCUMENTS

| | | | | |
|---|---|---|---|---|
| 4,082,576 | A | 4/1978 | Lake et al. | |
| 4,152,140 | A | 5/1979 | Hori et al. | |
| 4,468,249 | A | 8/1984 | Lehman | |
| 4,534,805 | A | 8/1985 | Jesseman | |
| 4,745,786 | A | 5/1988 | Wakako et al. | |
| 4,746,361 | A | 5/1988 | Pielet et al. | |
| 4,832,757 | A | 5/1989 | Cox et al. | |
| 4,851,052 | A | 7/1989 | Nishioka et al. | |
| 5,720,336 | A | 2/1998 | Strezov | |
| 5,934,359 | A | 8/1999 | Strezov | |
| 5,985,051 | A | 11/1999 | Yamamoto et al. | |
| 6,059,014 | A | 5/2000 | Strezov | |
| 6,073,679 | A | 6/2000 | Strezov | |
| 6,129,791 | A | 10/2000 | Nakajima et al. | |
| 6,358,338 | B1 | 3/2002 | Guelton et al. | |
| 6,364,967 | B1 | 4/2002 | Yamamoto et al. | |
| 6,488,790 | B1 | 12/2002 | Hartmann et al. | |
| 6,491,089 | B1 | 12/2002 | Poirier et al. | |
| 6,502,626 | B1 * | 1/2003 | Mascanzoni et al. | 164/476 |
| 6,547,849 | B2 | 4/2003 | Gross et al. | |
| 6,558,486 | B1 | 5/2003 | Strezov et al. | |
| 6,588,494 | B1 | 7/2003 | Mazurier | |
| 6,663,725 | B2 * | 12/2003 | Inoue et al. | 148/320 |
| 6,818,073 | B2 | 11/2004 | Strezov et al. | |
| 6,855,218 | B1 | 2/2005 | Kawalla et al. | |
| 6,939,415 | B2 | 9/2005 | Iseda et al. | |
| 6,942,013 | B2 | 9/2005 | Strezov et al. | |
| 7,252,722 | B2 | 8/2007 | Nakajima et al. | |
| 2003/0111206 | A1 | 6/2003 | Blejde et al. | |
| 2003/0185700 | A1 | 10/2003 | Ishii et al. | |
| 2004/0177944 | A1 | 9/2004 | Blejde et al. | |
| 2004/0177945 | A1 | 9/2004 | Blejde et al. | |
| 2008/0219879 | A1 | 9/2008 | Williams et al. | |
| 2009/0277546 | A1 | 11/2009 | Hammer et al. | |
| 2010/0043513 | A1 | 2/2010 | Hammer et al. | |
| 2010/0065161 | A1 | 3/2010 | Hammer et al. | |
| 2010/0065162 | A1 | 3/2010 | Hammer et al. | |
| 2010/0096047 | A1 | 4/2010 | Hammer et al. | |

FOREIGN PATENT DOCUMENTS

| | | | |
|---|---|---|---|
| AU | 2001291499 | | 4/2002 |
| AU | 2005200300 | | 8/2005 |
| BE | 875003 | | 7/1979 |
| BR | 9810193 | | 8/2000 |
| BR | 200114338 | | 12/2003 |
| CA | 2294333 | | 12/1998 |
| CA | 2284124 | | 9/1999 |
| CA | 2420492 | | 4/2002 |
| CN | 1260740 | | 7/2000 |
| CN | 1458870 | | 11/2003 |
| CZ | 293823 | | 8/2004 |
| DE | 265641 | | 3/1989 |
| DE | 69832886 | | 1/2006 |
| EP | 0040553 | | 11/1981 |
| EP | 0732163 | | 9/1996 |
| EP | 0800881 | | 10/1997 |
| EP | 1007248 | | 6/2000 |
| EP | 1143022 | | 10/2001 |
| EP | 1399598 | | 6/2002 |
| EP | 1493832 | | 11/2006 |
| JP | 57130750 | | 8/1982 |
| JP | 57134249 | | 8/1982 |
| JP | 5831026 | | 2/1983 |
| JP | 58113318 | | 7/1983 |
| JP | 58193319 | | 11/1983 |
| JP | 62050054 | A | 3/1987 |
| JP | 64017824 | A | 1/1989 |
| JP | 02160145 | | 6/1990 |
| JP | 02179343 | | 7/1990 |
| JP | 02179843 | | 7/1990 |
| JP | 02205618 | | 8/1990 |
| JP | 03249126 | | 7/1991 |
| JP | 03249128 | | 7/1991 |
| JP | 03291139 | | 12/1991 |
| JP | 0517821 | | 1/1993 |
| JP | 05289549 | | 10/1995 |
| JP | 0853714 | | 2/1996 |
| JP | 08188847 | | 7/1996 |
| JP | 08281382 | | 10/1996 |
| JP | 08294751 | | 11/1996 |
| JP | 10219392 | | 8/1998 |
| JP | 11061253 | | 3/1999 |
| JP | 11158538 | | 6/1999 |
| JP | 11350064 | | 12/1999 |
| JP | 2000178634 | | 6/2000 |
| JP | 2001502974 | | 3/2001 |
| JP | 2001123245 | | 5/2001 |
| JP | 2001152255 | | 6/2001 |
| JP | 2001342543 | | 12/2001 |
| JP | 2001355039 | | 12/2001 |
| JP | 2003138340 | | 5/2003 |
| JP | 2003147477 | | 5/2003 |
| JP | 2004018971 | | 1/2004 |
| JP | 2004508942 | | 3/2004 |
| JP | 2004211157 | | 7/2004 |
| KR | 1020010013946 | | 2/2001 |
| KR | 1020010075195 | | 8/2001 |
| KR | 20020040210 | | 6/2002 |
| KR | 20020048034 | | 6/2002 |
| KR | 20020048199 | | 6/2002 |
| KR | 1020030064760 | | 8/2003 |
| MX | PA03001971 | | 9/2004 |
| PL | 186657 | | 2/2004 |
| RU | 2212976 | | 9/2003 |
| SK | 181499 | | 3/2001 |
| TR | 9903146 | | 7/2000 |
| UA | 61113 | | 8/2000 |
| WO | 19940012300 | | 6/1994 |
| WO | 19950013889 | | 5/1995 |
| WO | 19950913155 | | 5/1995 |
| WO | 19980055251 | | 12/1998 |
| WO | 19980057767 | | 12/1998 |
| WO | 20000007753 | | 2/2000 |
| WO | 20010020051 | | 3/2001 |
| WO | 20020026422 | | 4/2002 |
| WO | 20030002772 | | 1/2003 |
| WO | 20030024644 | | 3/2003 |
| WO | 20050031021 | | 4/2005 |
| WO | 20070095695 | | 8/2007 |
| WO | 20080054166 | | 5/2008 |

(56) References Cited

FOREIGN PATENT DOCUMENTS

OTHER PUBLICATIONS

Bordignon et al., High Strenth Low-Allow Steels for Automotive Applications, Niobium Technical Report, NbTR-06/84, Dec. 1984 ISSN-0101-5963.

Constitution and properties of Steels, Materials Science and Technology, 1992, pp. 49, 272, 273, 337, 350, 351, vol. 7, VCH Verlagsgesellschaft mbH, Federal Republic of Germany.

Klaus Hulka, Niobium Products Company GmbH, Dusseldorf, Germany, The Role of Niobium in Low Carbon Bainitic HSLA Steel, Oct. 2005.

Krauss et al., "Ferritic Microstructures in Continuously Cooled Low- and Ultralow-carbon steels", ISIJ International (The Iron and Steel Institute of Japan), vol. 35, No. 8 (1995), pp. 937-945.

Lake et al., Partially Annealed High Strength Cold Rolled Steels, Biblioteheek T.U.E. ADM., Nov. 7, 2005, pp. 1-12, Society of Automotive Engineers, Inc.

Ludlow et al., European Commission, Technical Steel Research, Casting, reheating and direct rolling, Precipitation of nitrides and carbides during solidification and cooling, Contract No. 7210-PR/213, Jul. 1, 2000 to Jun. 30, 2004, Final Report, pp. 43, 135-137, 140, 141, 144, 145, 147-149, 152, 154, 155, 197, 245, 247, 277, 289, European Communities, 2006, Luxembourg.

Maugis et al., European Commission, Technocal Steel Research, Physical metallurgy of rolling and finishing, Development of methods for the characterization and modeling of precipitation in steels, Jul. 1, 1999 to Jun. 30, 2002, Contract No. 7210-PR/160, Final Report, pp. 20, 21, 23, 25, 42, 45, 46, 48, 51, 84, 139, 140, 187, 188, 190, 191, 205, 206, 209, 212, European Communities, 2004, Luxembourg.

Penning et al., The development of recovery annealed steels, International Journal of Materials and Product Technology, 1995, vol. 10, Nr. 3-6, pp. 325-337, Inderscience Engerprises Ltd.

Recent Development in Project M the Joint Development of Low Carbon Steel Strip Casting by BHP and IHI, presented at the METEC Congress 99, Dusseldorf Germany (Jun. 13-15, 1999), p. 176-181.

Schneider et al., Titanium-Bearing High Strength Cold Rolled Steels, Proceedings of the 22nd Mechanical Working & Steel Processing Conference XVIII, Oct. 29-30, 1980, pp. 398-429, Toronto, Ontario.

Schwinn et al., Low carbon bainitic TMCP plate for structural and linepipe applications.

* cited by examiner

HIGH STRENGTH THIN CAST STRIP PRODUCT AND METHOD FOR MAKING THE SAME

This application claims priority to and the benefit of U.S. Provisional Application 61/154,231, filed Feb. 20, 2009. This application also claims priority to and the benefit of U.S. patent application Ser. No. 12/116,039, filed May 6, 2008, as a continuation-in-part, which U.S. patent application Ser. No. 12/116,039 claims priority to U.S. Provisional Application 60/943,781, filed Jun. 13, 2007, U.S. patent application Ser. No. 11/744,881, filed May 6, 2007, and U.S. patent application Ser. No. 11/255,604, filed Oct. 20, 2005, now U.S. Pat. No. 7,485,196.

BACKGROUND AND SUMMARY

This invention relates to making of high strength thin cast strip, and the method for making such cast strip by a twin roll caster.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

In the past, high-strength low-carbon thin strip with yield strengths of 413 MPa (60 ksi) and higher, in strip thicknesses less than 3.0 mm, have been made by recovery annealing of cold rolled strip. Cold rolling was required to produce the desired thickness. The cold roll strip was then recovery annealed to improve the ductility without significantly reducing the strength. However, the final ductility of the resulting strip still was relatively low and the strip would not achieve total elongation levels over 6%, which is required for structural steels by some building codes for structural components. Such recovery annealed cold rolled, low-carbon steel was generally suitable only for simple forming operations, e.g., roll forming and bending. To produce this steel strip with higher ductility was not technically feasible in these final strip thicknesses using the cold rolled and recovery annealed manufacturing route.

Additionally, the steel strip for certain cold formed structural sections, such as for some residential framing standards, may have a total elongation of at least 10% and a tensile strength to yield strength ratio of at least 1.08. In prior hot dip coated steel products with strip thicknesses less than about 1.6 mm, such requirements could not be achieved using full hard cold rolled material. Typically very expensive microalloying options and processing parameters were used to achieve a total elongation of at least 10% and a tensile strength to yield strength ratio of at least 1.08.

In the past, such high strength steel had been made by microalloying with elements such as niobium, vanadium, titanium or molybdenum, and hot rolling to achieve the desired thickness and strength level. Such microalloying required expensive and high levels of niobium, vanadium, titanium or molybdenum and resulted in formation of a bainite-ferrite microstructure typically with 10 to 20% bainite. See U.S. Pat. No. 6,488,790. Alternatively, the microstructure could be ferrite with 10-20% pearlite. Hot rolling the strip resulted in the partial precipitation of these alloying elements. As a result, relatively high alloying levels of the Nb, V, Ti or Mo elements were required to provide enough age hardening of the predominately ferritic transformed microstructure to achieve the required strength levels. These high microalloying levels significantly raised the hot rolling loads needed and restricted the thickness range of the hot rolled strip that could be economically and practically produced. Such alloyed high strength strip could be directly used for galvanizing after pickling for the thicker end of the product range greater than 3 mm in thickness.

However, making of high strength, steel strip less than 3 mm in thickness with additions of Nb, V, Ti or Mo to the base steel chemistry was very difficult, particularly for wide strip due to the high rolling loads, and not always commercially feasible. In the past, large additions of these elements were needed for strengthening the steel, and in addition, caused reductions in elongation properties of the steel. High strength microalloyed hot rolled strips in the past were relatively inefficient in providing strength, relatively expensive, and often required compensating additions of other alloying elements.

Additionally, cold rolling was generally required for lower thicknesses of strip; however, the high strength of the hot rolled strip made such cold rolling difficult because of the high cold roll loadings required to reduce the thickness of the strip. These high alloying levels also considerably raised the recrystallization annealing temperature needed, requiring expensive to build and operate annealing lines capable of achieving the high annealing temperature needed for full recrystallization annealing of the cold rolled strip.

In short, the application of previously known microalloying practices with Nb, V, Ti or Mo elements to produce high strength thin strip could not be commercially produced economically because of the high alloying costs, relative inefficiency of element additions, difficulties with high rolling loads in hot rolling and cold rolling, and the high recrystallization annealing temperatures required.

A steel product is disclosed comprising, by weight, less than 0.25% carbon, between 0.20 and 2.0% manganese, between 0.05 and 0.50% silicon, less than 0.01% aluminum, and niobium between about 0.01% and about 0.20% and having a majority of the microstructure comprised of bainite and acicular ferrite and having more than 70% niobium in solid solution. Alternatively, the niobium may be less than 0.1%. The steel product may further comprise at least one element selected from the group consisting of molybdenum between about 0.05% and about 0.50%, vanadium between about 0.01% and about 0.20%, and a mixture thereof. Alternatively or in addition, the steel product may have a ratio of vanadium to nitrogen content greater than 4:1 by weight. Alternatively or in addition, the steel product may have a ratio of vanadium to nitrogen content between 4:1 and 7:1 by weight.

The molten steel cast may have a free oxygen content between 20 and 70 ppm, and may be between 30 and 55 ppm. The total oxygen content of the molten metal for the steel product may be between 70 ppm and 150 ppm.

The steel product may have a yield strength of at least 340 MPa, and may have a tensile strength of at least 410 MPa. The steel product may have a yield strength of at least 485 MPa and a tensile strength of at least of at least 520 MPa. The tensile strength to yield strength ratio of the steel product may be at least 1.08. The steel product has a total elongation of at least 6%. Alternatively, the total elongation may be at least 10%. In any case, mechanical properties of the steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation.

The steel product may be a thin cast steel strip. Optionally, the thin cast steel strip may have fine oxide particles of silicon and iron distributed through the steel microstructure having an average particle size less than 50 nanometers.

The thin cast steel strip may have a thickness of less than 2.5 mm. Alternatively, the thin cast steel strip may have a thickness of less than 2.0 mm. In yet another alternative, the thin cast steel strip may have a thickness in the range from about 0.5 mm to about 2 mm.

The hot rolled steel product of less than 3 millimeters thickness is also disclosed comprising, by weight, less than 0.25% carbon, between 0.20 and 2.0% manganese, between 0.05% and 0.50% silicon, less than 0.01% aluminum, and niobium between about 0.01% and about 0.20%, and have a majority of the microstructure comprised of bainite and acicular ferrite and capable of providing a yield strength of at least 410 MPa with a reduction of between 20% and 40%. The steel product may have a yield strength of at least 485 MPa and a tensile strength of at least of at least 520 MPa. Alternatively, the niobium may be less than 0.1%. The tensile strength to yield strength ratio of the hot rolled steel product may be at least 1.08. Mechanical properties of the hot rolled steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation.

Optionally, the hot rolled steel product may have fine oxide particles of silicon and iron distributed through the steel microstructure having an average particle size less than 50 nanometers.

The hot rolled steel product has a total elongation of at least 6%. Alternatively, the total elongation may be at least 10%. The hot rolled steel product may have a thickness of less than 2.5 mm. Alternatively, the hot rolled steel product may have a thickness of less than 2.0 mm. In yet another alternative, the hot rolled steel product may have a thickness in the range from about 0.5 mm to about 2 mm.

Also disclosed is a coiled steel product comprised, by weight, of less than 0.25% carbon, between 0.20 and 2.0% manganese, between 0.05 and 0.50% silicon, less than 0.01% aluminum, and at least one element selected from the group consisting of niobium between about 0.01% and about 0.20%, vanadium between about 0.01% and about 0.20%, and a mixture thereof, and having more than 70% niobium and/or vanadium in solid solution after coiling and cooling. Alternatively, the niobium may be less than 0.1%. Alternatively or in addition, the coiled steel product may have a ratio of vanadium to nitrogen content greater than 4:1 by weight. Alternatively or in addition, the coiled steel product may have a ratio of vanadium to nitrogen content between 4:1 and 7:1 by weight.

Optionally, the coiled steel product may have fine oxide particles of silicon and iron distributed through the steel microstructure having an average particle size less than 50 nanometers.

The coiled steel product may have a yield strength of at least 340 MPa, and may have a tensile strength of at least 410 MPa. The coiled steel product has a thickness of less than 3.0 mm. The steel product may have a yield strength of at least 485 MPa and a tensile strength of at least of at least 520 MPa. The tensile strength to yield strength ratio of the coiled steel product may be at least 1.08. Also, mechanical properties of the steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation.

Alternatively, the coiled steel product has a thickness of less than 2.5 mm. Alternatively, the coiled steel product may have a thickness of less than 2.0 mm. In yet another alternative, the coiled steel product may have a thickness in the range from about 0.5 mm to about 2 mm. The coiled steel product has a total elongation of at least 6%. Alternatively, the total elongation may be at least 10%.

An age hardened steel product is also disclosed comprising, by weight, less than 0.25% carbon, between 0.20 and 2.0% manganese, between 0.05 and 0.50% silicon, less than 0.01% aluminum, at least one element from the group consisting of niobium between about 0.01% and about 0.20%, vanadium between about 0.01% and about 0.20%, and a mixture thereof, and having a majority of the microstructure comprised of bainite and acicular ferrite and having an increase in elongation and an increase in yield strength after age hardening. Alternatively, the niobium may be less than 0.1%. Alternatively or in addition, the age hardened steel product may have a ratio of vanadium to nitrogen content greater than 4:1 by weight. Alternatively or in addition, the age hardened steel product may have a ratio of vanadium to nitrogen content between 4:1 and 7:1 by weight.

The molten steel cast may have a free oxygen content between 20 and 70 ppm, and may be between 30 and 55 ppm. The total oxygen content of the molten metal for the age hardened steel product may be between 70 ppm and 150 ppm.

The age hardened steel product may comprise, in addition, fine oxide particles of silicon and iron distributed through the steel microstructure having an average particle size less than 50 nanometers. Mechanical properties of the age hardened steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation. The age hardened steel product may include one or both of a zinc coating or a zinc alloy coating.

The steel product may have a yield strength of at least 340 MPa, or at least 380 MPa, or at least 410 MPa, or at least 450 MPa, or at least 500 MPa, or at least 550 MPa, or at least 600 MPa, or at least 650 MPa, as desired. The steel product may have a tensile strength of at least 410 MPa, or at least 450 MPa, or at least 500 MPa, or at least 550 MPa, or at least 600 MPa, or at least 650 MPa, or at least 700 MPa, as desired. The tensile strength to yield strength ratio may be at least 1.08. The age hardened steel product has a thickness of less than 3.0 mm. Alternatively, the age hardened steel product has a thickness of less than 2.5 mm. Alternatively, the age hardened steel product may have a thickness of less than 2.0 mm. In yet another alternative, the age hardened steel product may have a thickness in the range from about 0.5 mm to about 2 mm. The age hardened steel product has a total elongation of at least 6%. Alternatively, the total elongation may be at least 10%.

A steel product comprising, by weight, less than 0.25% carbon, between 0.20 and 2.0% manganese, between 0.05 and 0.50% silicon, less than 0.01% aluminum, and at least one element selected from the group consisting of niobium between about 0.01% and about 0.20% and vanadium between about 0.01% and about 0.20%, and having a majority of the microstructure comprised of bainite and acicular ferrite and comprising fine oxide particles of silicon and iron distributed through the steel microstructure having an average particle size less than 50 nanometers. Alternatively, the niobium may be less than 0.1%. Optionally, the steel product may comprise molybdenum between about 0.05% and 0.50%. Alternatively or in addition, the steel product may have a ratio of vanadium to nitrogen content greater than 4:1 by weight. Alternatively or in addition, the steel product may have a ratio of vanadium to nitrogen content between 4:1 and 7:1 by weight.

The steel product may have a yield strength of at least 340 MPa, and may have a tensile strength of at least 410 MPa. The steel product may have a yield strength of at least 485 MPa and a tensile strength of at least of at least 520 MPa. The tensile strength to yield strength ratio may be at least 1.08. Mechanical properties of the steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation. The steel product has a total elongation of at least 6%. Alternatively, the total elongation may be at least 10%.

An age hardened steel product comprising, by weight, less than 0.25% carbon, between 0.20 and 2.0% manganese, between 0.05 and 0.50% silicon, less than 0.01% aluminum, and niobium between about 0.01% and about 0.20%, and having a majority of the microstructure comprised of bainite and acicular ferrite and having niobium carbonitride particles with an average particle size of less than 10 nanometers. Carbonitride particles, in the present specification and appended claims, includes carbides, nitrides, carbonitrides, and combinations thereof. Alternatively, the niobium may be less than 0.1%.

The age hardened steel product may have substantially no niobium carbonitride particles greater than 50 nanometers. The age hardened steel product may have a yield strength of at least 340 MPa, and may have a tensile strength of at least 410 MPa. The tensile strength to yield strength ratio may be at least 1.08. The age hardened steel product has a total elongation of at least 6%. Alternatively, the total elongation may be at least 10%. Mechanical properties of the age hardened steel product at 15% and 35% reduction may be within 10% for yield strength, tensile strength, and total elongation. Alternatively, mechanical properties of the steel product may be within 10% throughout the range from 15% to 35% reduction for yield strength, tensile strength, and total elongation. The age hardened steel product may include one or both of a zinc coating or a zinc alloy coating.

A method is disclosed for preparing coiled thin cast steel strip comprising the steps of:

assembling internally a cooled roll caster having laterally positioned casting rolls forming a nip between them, and forming a casting pool of molten steel supported on the casting rolls above the nip and confined adjacent the ends of the casting rolls by side dams, counter rotating the casting rolls to solidify metal shells on the casting rolls as the casting rolls move through the casting pool, forming from the metal shells downwardly through the nip between the casting rolls a steel strip having a composition comprising by weight, less than 0.25% carbon, between 0.20 and 2.0% manganese, between 0.05 and 0.50% silicon, less than 0.01% aluminum, and at least one element selected from the group consisting of niobium between about 0.01% and about 0.20%, vanadium between about 0.01% and about 0.20%, and a mixture thereof, cooling the steel strip at a rate of at least 10° C. per second to provide a majority of the microstructure comprising bainite and acicular ferrite and having more than 70% niobium and/or vanadium in solid solution.

The molten steel may have a free oxygen content between 20 and 70 ppm, and may be between 30 and 55 ppm. The total oxygen content of the molten metal for the thin cast steel strip may be between 70 ppm and 150 ppm.

Alternatively or in addition, the steel strip may have a ratio of vanadium to nitrogen content greater than 4:1 by weight. Alternatively or in addition, the steel strip may have a ratio of vanadium to nitrogen content between 4:1 and 7:1 by weight.

The method may provide in the steel strip as coiled fine oxide particles of silicon and iron distributed through the steel microstructure having an average particle size less than 50 nanometers. Further, the method may comprise the steps of hot rolling the steel strip, and coiling the hot rolled steel strip at a temperature between about 450 and 700° C. Alternatively, the coiling of the hot rolled steel strip may be at a temperature less than 650° C.

The method may further comprise the step of age hardening the steel strip to increase the tensile strength at a temperature of at least 550° C. Alternatively, the age hardening may occur at a temperature between 625° C. and 800° C. In yet another alternative, the age hardening may occur at a temperature between 650° C. and 750° C. The method may include the step of hot dip coating the steel strip to provide a coating of zinc or a zinc alloy.

Also disclosed is a method of preparing a thin cast steel strip comprised the steps of:

assembling an internally cooled roll caster having laterally positioned casting rolls forming a nip between them, and forming a casting pool of molten steel supported on the casting rolls above the nip and confined adjacent the ends of the casting rolls by side dams, counter rotating the casting rolls to solidify metal shells on the casting rolls as the casting rolls move through the casting pool, and forming steel strip from the metal shells cast downwardly through the nip between the casting rolls having a composition comprising by weight, less than 0.25% carbon, less than 0.01% aluminum, and at least one element from the group consisting of niobium between about 0.01% and about 0.20%, vanadium between about 0.01% and about 0.20%, and a mixture thereof, and cooling the steel strip at a rate of at least 10° C. per second to provide a majority of the microstructure comprising bainite and acicular ferrite and having more than 70% niobium and/or vanadium in solid solution, optionally cold rolling the steel strip with a cold reduction between about 10 and 35%, and age hardening the steel strip at a temperature between 625° C. and 800° C.

Alternatively or in addition, the steel strip may have a ratio of vanadium to nitrogen content greater than 4:1 by weight. Alternatively or in addition, the steel strip may have a ratio of vanadium to nitrogen content between 4:1 and 7:1 by weight.

The molten steel may have a free oxygen content between 20 and 70 ppm, and may be between 30 and 55 ppm. The total oxygen content of the molten metal for the thin cast steel strip may be between 70 ppm and 150 ppm.

The method may further comprise the step of age hardening the steel strip to increase the tensile strength. Alternatively, the age hardening may occur at a temperature between 650° C. and 750° C. The step of age hardening may include hot dip coating the steel strip to provide a coating of zinc or a zinc alloy.

The method may provide the age hardened steel strip having niobium carbonitride particles with an average particle size of less than 10 nanometers. Alternatively, the age hardened steel strip has substantially no niobium carbonitride particles greater than 50 nanometers.

The method may provide in the steel strip as coiled fine oxide particles of silicon and iron distributed through the steel microstructure having an average particle size less than 50 nanometers. Further, the method may comprise the steps of hot rolling the steel strip, and coiling the hot rolled steel strip at a temperature less than 700° C. Alternatively, the coiling of the hot rolled steel strip may be at a temperature less than 650° C.

The method of preparing a thin cast steel strip may comprise the steps of:

assembling internally a cooled roll caster having laterally positioned casting rolls forming a nip between them, and forming a casting pool of molten steel supported on the casting rolls above the nip and confined adjacent the ends of the casting rolls by side dams, counter rotating the casting rolls to solidify metal shells on the casting rolls as the casting rolls move through the casting pool; and forming from the metal shells downwardly through the nip between the casting rolls a steel strip having a composition comprising by weight, less than 0.25% carbon, between 0.20 and 2.0% manganese, between 0.05 and 0.50% silicon, less than 0.01% aluminum, and at least one element from the group consisting of niobium between about 0.01% and about 0.20%, vanadium between about 0.01% and about 0.20%, and a mixture thereof, cooling the steel strip at a rate of at least 10° C. per second to provide a majority of the microstructure comprising bainite and acicular ferrite, optionally cold rolling the steel strip with a cold reduction between about 10 and 35%, and age hardening the steel strip at a temperature between 625° C. and 800° C. and having an increase in elongation and an increase in yield strength after age hardening.

Alternatively or in addition, the steel strip may have a ratio of vanadium to nitrogen content greater than 4:1 by weight. Alternatively or in addition, the steel strip may have a ratio of vanadium to nitrogen content between 4:1 and 7:1 by weight.

The molten steel may have a free oxygen content between 20 and 70 ppm, and may be between 30 and 55 ppm. The total oxygen content of the molten metal for the thin cast steel strip may be between 70 ppm and 150 ppm.

The method may provide in the steel strip as coiled fine oxide particles of silicon and iron distributed through the steel microstructure having an average particle size less than 50 nanometers. Further, the method may provide the age hardened steel strip having niobium carbonitride particles with an average particle size of less than 10 nanometers. Alternatively, the age hardened steel strip has substantially no niobium carbonitride particles greater than 50 nanometers.

The method may comprise the steps of hot rolling the steel strip, and coiling the hot rolled steel strip at a temperature less than 750° C. Alternatively, the coiling of the hot rolled steel strip may be at a temperature less than 700° C. The step of age hardening may include hot dip coating the steel strip to provide a coating of zinc or a zinc alloy.

BRIEF DESCRIPTION OF THE DRAWINGS

In order that the invention may be described in more detail, some illustrative examples will be given with reference to the accompanying drawings in which.

DETAILED DESCRIPTION OF THE DRAWINGS

Figure 1:
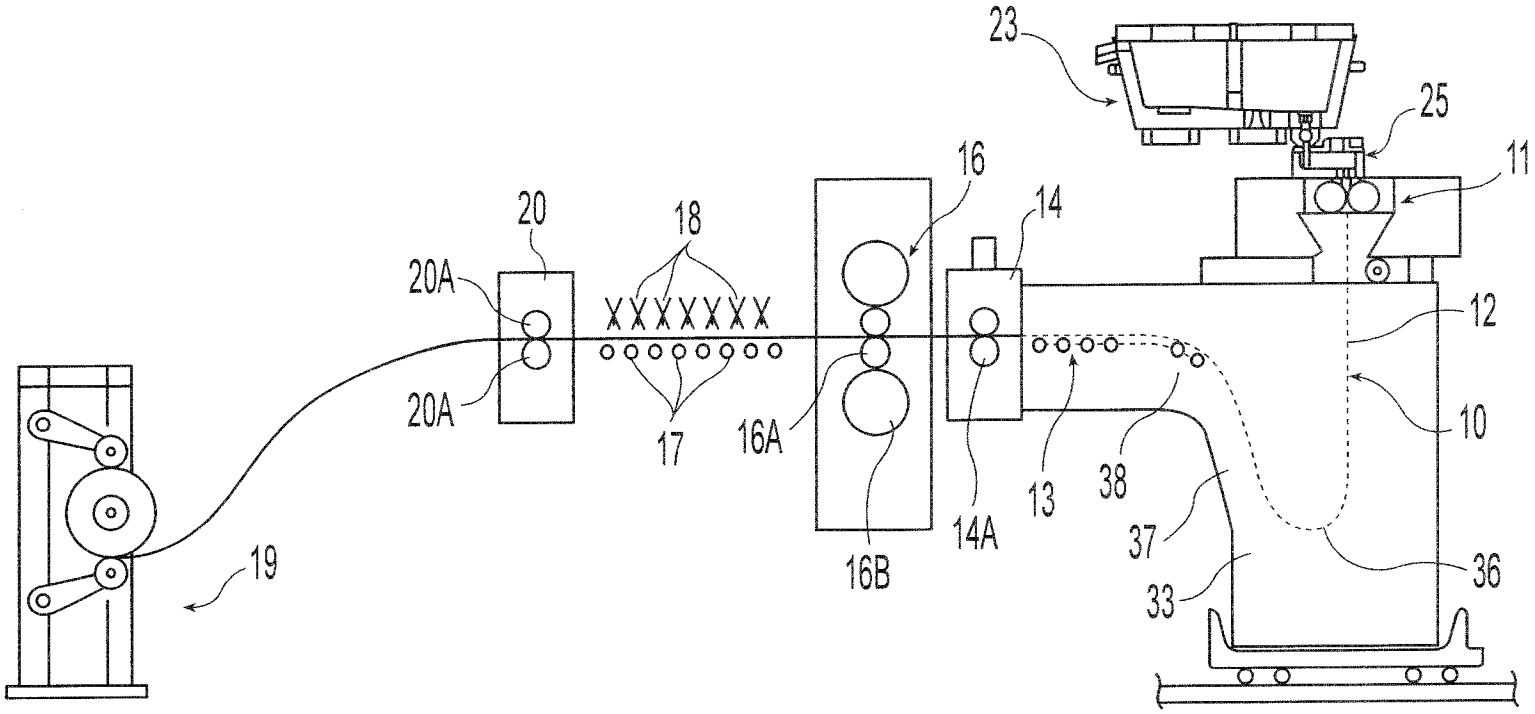
FIG. 1 illustrates a strip casting installation incorporating an in-line hot rolling mill and coiler.
Figure 2:
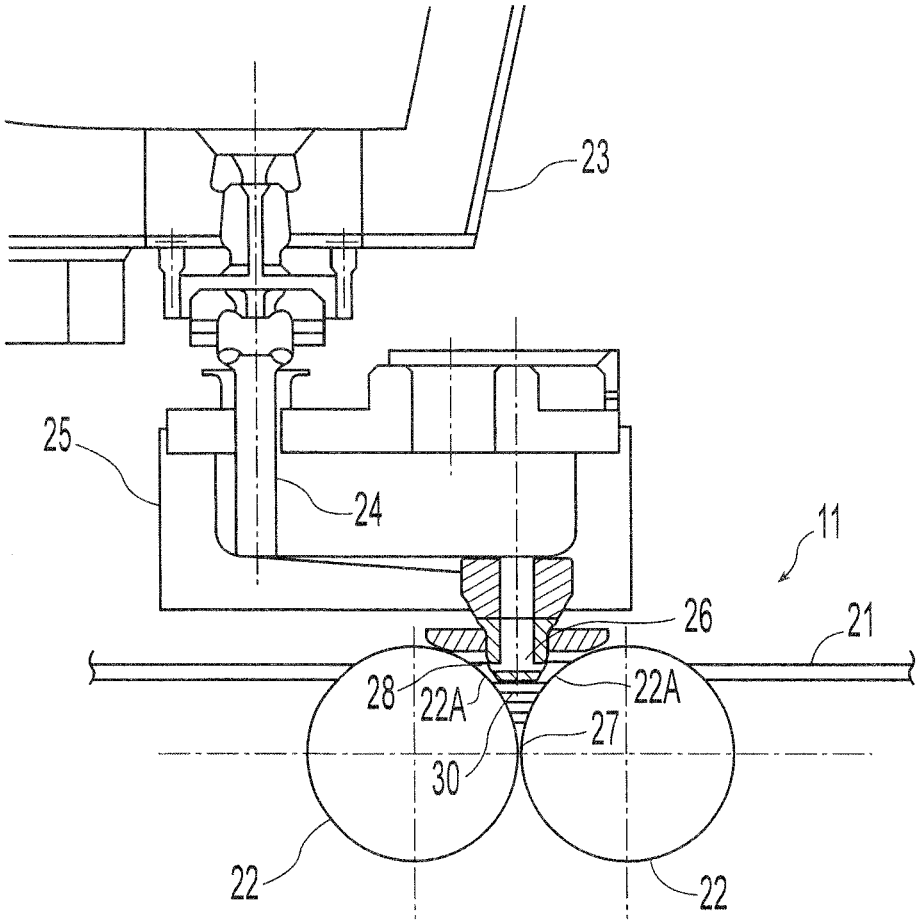
FIG. 2 illustrates details of the twin roll strip caster.

FIG. 1 illustrates successive parts of strip caster for continuously casting steel strip. FIGS. 1 and 2 illustrate a twin roll caster 11 that continuously produces a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of reduction rolls 16A and backing rolls 16B where the cast strip is hot rolled to reduce a desired thickness. The hot rolled strip passes onto a run-out table 17 where the strip may be cooled by convection and contact with water supplied via water jets 18 (or other suitable means) and by radiation. The rolled and cooled strip is then passes through a pinch roll stand 20 comprising a pair of pinch rolls 20A and then to a coiler 19. Final cooling of the cast strip takes place after coiling.

As shown in FIG. 2, twin roll caster 11 comprises a main machine frame 21, which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the distributor 25 through a metal delivery nozzle 26 between the casting rolls 22 above the nip 27. The molten metal delivered between the casting rolls 22 forms a casting pool 30 above the nip. The casting pool 30 is restrained at the ends of the casting rolls by a pair of side closure dams or plates 28, which are pushed against the ends of the casting rolls by a pair of thrusters (not shown) including hydraulic cylinder units (not shown) connected to the side plate holders. The upper surface of casting pool 30 (generally referred to as the "meniscus" level) usually rises above the lower end of the delivery nozzle so that the lower end of the delivery nozzle is immersed within the casting pool 30. Casting rolls 22 are internally water cooled so that shells solidify on the moving roller surfaces as they pass through the casting pool, and are brought together at the nip 27 between them to produce the cast strip 12, which is delivered downwardly from the nip between the casting rolls.

The twin roll caster may be of the kind that is illustrated and described in some detail in U.S. Pat. Nos. 5,184,668 and 5,277,243 or U.S. Pat. No. 5,488,988, or U.S. patent application Ser. No. 12/050,987. Reference may be made to those patents for appropriate construction details of a twin roll caster appropriate for use in an embodiment of the present invention.

By employing rapid solidification rates with control of certain parameters, the present alloy design generates liquid deoxidation products of MnO and $SiO_2$ in a fine and uniform distribution of globular inclusions. The $MnO.SiO_2$ inclusions present are also not significantly elongated by the in-line hot rolling process, due to limited hot reduction. The inclusion/particle populations are tailored to stimulate nucleation of acicular ferrite. The $MnO.SiO_2$ inclusions may be about 10 μm down to very fine particles of less than 0.1 μm, and a majority being between about 0.5 μm and 5 μm. The larger 0.5-10 μm size non-metallic inclusions are provided for nucleating acicular ferrite, and may include a mixture of inclusions, for example including MnS, TiO and CuS. The austenite grain size is significantly larger than the austenite grain size produced in conventional hot rolled strip steel. The coarse austenite grain size, in conjunction with the population of tailored inclusion/particles, assists with the nucleation of acicular ferrite and bainite.

The in-line hot rolling mill 16 is typically used for reductions of 10 to 50%. On the run-out-table 17 the cooling may include water cooling section and air mist cooling to control cooling rates of austenite transformation to achieve desired microstructure and material properties.

Hot reductions larger than about 20% can induce the recrystallization of austenite, which reduces the grain size and volume fraction of acicular ferrite. We have found that the addition of alloying elements increasing the hardenability of the steel suppressed the recrystallization of the coarse as-cast austenite grain size during the hot rolling process, and resulted in the hardenability of the steel being retained after hot rolling, enabling thinner material to be produced with the desired microstructure and mechanical properties.

Microalloying elements in steel are commonly taken to refer to the elements titanium niobium, and vanadium. These elements were usually added in the past in levels below 0.1%, but in some cases levels as high as 0.2%. These elements are capable of exerting strong effects on the steel microstructure and properties via a combination of hardenability, grain refining and strengthening effects (in the past as carbonitride formers). Molybdenum has not normally been regarded as a microalloying element since on its own it is a relatively weak carbonitride former, but may be effective in the present circumstances and may form complex carbonitride particles along with niobium and vanadium. Carbonitride formation is inhibited in the hot rolled strip with these elements as explained below.

The high strength thin cast strip product combines several attributes to achieve a high strength light gauge cast strip product by microalloying with these elements. Strip thicknesses may be less than 3 mm, less than 2.5 mm, or less than 2.0 mm, and may be in a range of 0.5 mm to 2.0 mm. The cast strip is produced by hot rolling without the need for cold rolling to further reduce the strip to the desired thickness. Thus, the high strength thin cast strip product overlaps both the light gauge hot rolled thickness ranges and the cold rolled thickness ranges desired. The strip may be cooled at a rate of 10° C. per second and above, and still form a microstructure that is a majority and typically predominantly bainite and acicular ferrite.

The benefits achieved through the preparation of such a high strength thin cast strip product are in contrast to the production of previous conventionally produced microalloyed steels that result in relatively high alloy costs, inefficiencies in microalloying, difficulties in hot and cold rolling, and difficulties in recrystallization annealing since conventional continuous galvanizing and annealing lines are not capable of providing the high annealing temperatures needed. Moreover, the relatively poor ductility exhibited with strip made by the cold rolled and recovery annealed manufacturing route is overcome.

In previous conventionally produced microalloyed steels, elements such as niobium and vanadium could not remain in solid solution through solidification, hot rolling, coiling and cooling. The niobium and vanadium diffused through the microstructure forming carbonitride particles at various stages of the hot coil manufacturing process. Carbonitride particles, in the present specification and appended claims, includes carbides, nitrides, carbonitrides, and combinations thereof. The formation and growth of carbon and nitrogen particles in the hot slab and subsequent coiling of previous conventionally produced microalloyed steels further reduced the grain size of austenite in the hot slab, decreasing the hardenability of the steel. In these prior steels, the effect of particles in the hot slab had to be overcome by increasing the amount of microalloying elements, reheating the cast slabs to higher temperatures, and lowering carbon content.

In contrast to the previous conventionally produced steels, the present high strength thin cast steel strip product was produced comprising, by weight, less than 0.25% carbon, between 0.20 and 2.00% manganese, between 0.05 and 0.50% silicon, less than 0.06% aluminum, and at least one element selected from the group consisting of titanium between about 0.01% and about 0.20%, niobium between about 0.01% and about 0.20%, molybdenum between about 0.05% and about 0.50%, and vanadium between about 0.01% and about 0.20%, and having a microstructure comprising a majority bainite. The steel product may further comprising fine oxide particles of silicon and iron distributed through the steel microstructure having an average particle size less than 50 nanometers. The steel product may further comprise a more even distribution of microalloys through the microstructure than previously produced with conventional slab cast product.

Alternatively, the high strength thin cast steel strip product may comprise, by weight, less than 0.25% carbon, between 0.20 and 2.0% manganese, between 0.05 and 0.50% silicon, less than 0.01% aluminum, and niobium between about 0.01% and about 0.20%, and having a majority of the microstructure comprising bainite and acicular ferrite and having more than 70% soluble niobium.

In another alternative, a coiled steel product may comprise, by weight, less than 0.25% carbon, between 0.20 and 2.0% manganese, between 0.05 and 0.50% silicon, less than 0.01% aluminum, and at least one element selected from the group consisting of niobium between about 0.01% and about 0.20% and vanadium between about 0.01% and about 0.20%, and a combination thereof, and having more than 70% soluble niobium and vanadium, as selected, after coiling and cooling. The coiled high strength thin cast steel strip product may have more than 70% soluble niobium and vanadium, as selected, particularly after hot rolling reduction and subsequent coiling and before age hardening. The microstructure may be a mixture of bainite and acicular ferrite. Alternatively, the microstructure of the hot rolled and subsequently coiled and cooled steel may comprise bainite and acicular ferrite with more than 80% niobium and/or vanadium remaining in solid solution, and alternatively may have more than 90% remaining in solid solution.

Figure 8:
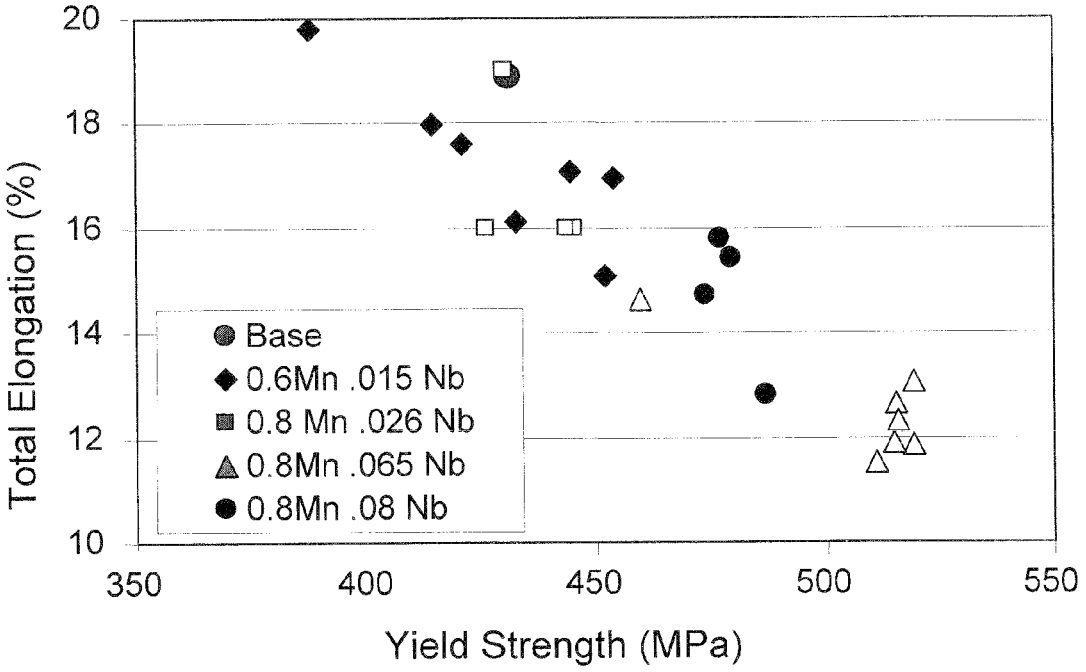
FIG. 8 is a graph showing the effect of yield strength on elongation.

Alternatively or in addition, the steel product may have a total elongation greater than 6% or greater than 10%. The steel product may have a yield strength of at least 340 MPa (about 49 ksi) or a tensile strength of at least 410 MPa, or both, exhibiting satisfactory ductility. The relationship between yield strength and total elongation in the hot rolled product is shown in FIG. 8.

After hot rolling the hot rolled steel strip may be coiled at a temperature in the range from about 500-700° C. The thin cast steel strip may also be further processed by age hardening the steel strip to increase the tensile strength at a temperature of at least 550° C. The age hardening may occur at a temperature between 550° C. and 800° C., or between 625° C. and 750° C., or between 675° C. and 750° C. Conventional furnaces of continuous galvanizing or annealing lines are thus capable of providing the age hardening temperatures needed to harden the microalloyed cast strip product.

For example, a steel composition was prepared by making a steel composition of a 0.026% niobium, 0.04% by weight carbon, 0.85% by weight manganese, 0.25% by weight silicon that has been cast by a thin cast strip process. The strip was cast at 1.7 mm thick and inline hot rolled to a range of strip thickness from 1.5 mm to 1.1 mm using a twin roll caster as illustrated in FIGS. 1 and 2. The strip was coiled at coiling temperatures of 590-620° C. (1094-1148° F.).

Figure 3:
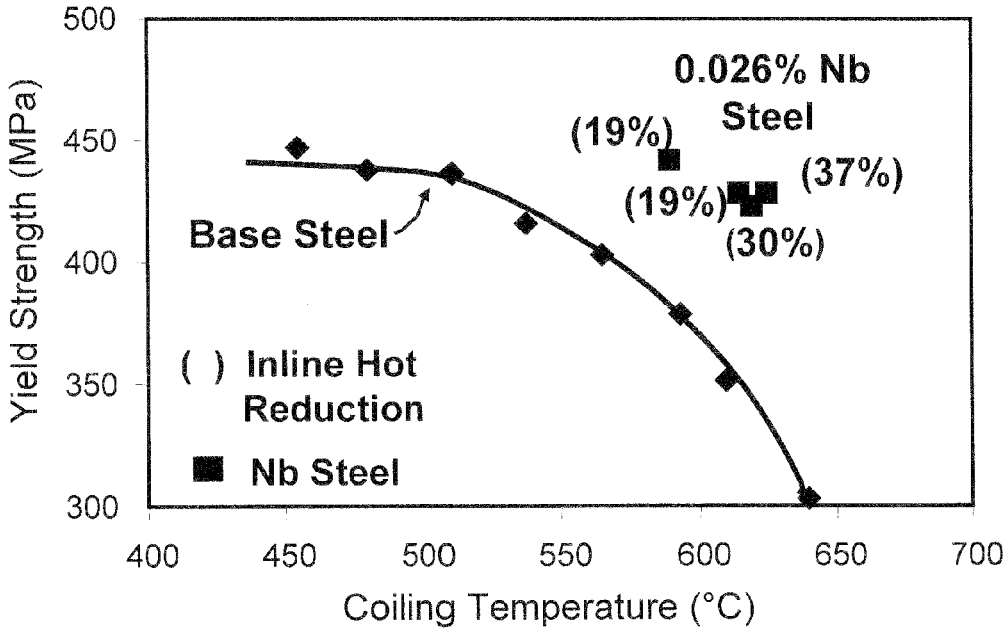
FIG. 3 illustrates the effect of coiling temperature on strip yield strength with and without niobium or vanadium additions.
Figure 7:
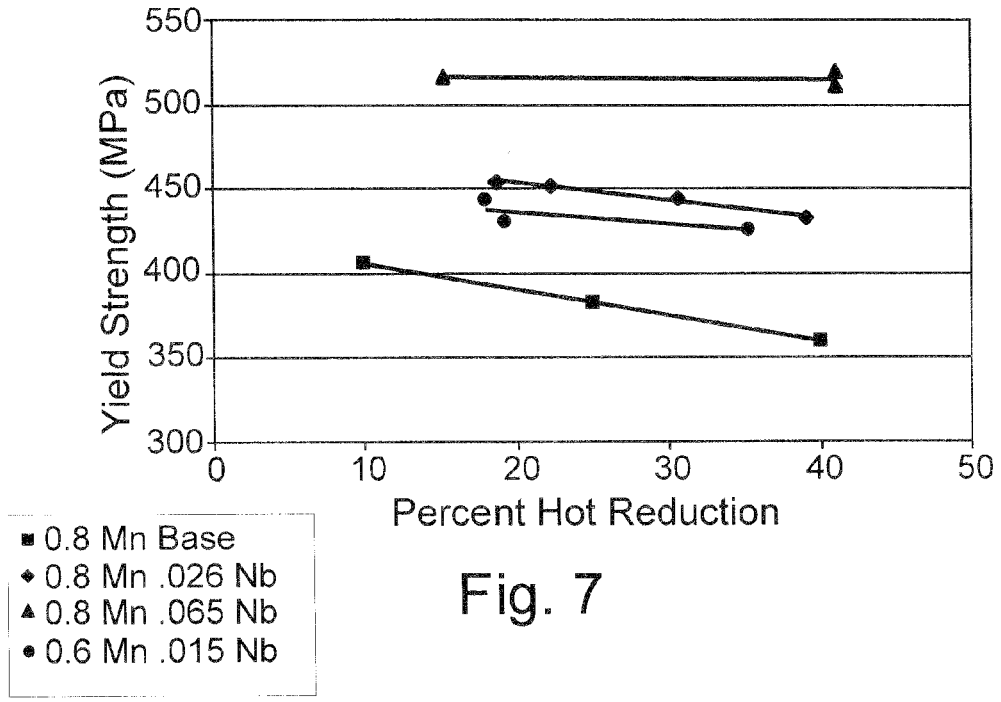
FIG. 7 is a graph showing the effect of hot rolling reduction on the yield strength.

As shown in FIG. 3, the yield and tensile strength levels achieved in the present cast strip are compared to the yield and tensile strength levels achievable in the base, non-microalloyed, cast strip steel composition over a range of coiling temperatures. It can be seen that the niobium steel strip achieved yield strengths in the range of 420-440 MPa (about 61-64 ksi) and tensile strengths of about 510 MPa (about 74 ksi). The tensile strength to yield strength ratio may be at least 1.08 in the present steel product. Alternatively, the tensile strength to yield strength ratio may be at least 1.10, and may be greater than 1.15. The present cast strip product is compared to C—Mn—Si base steel compositions processed with the same coiling temperature as the microalloyed steel, with the niobium steel producing substantially higher strength levels. The compared base steel strip had to be coiled at very low temperatures to approach comparable strength levels to the cast niobium steel product. The cast niobium steel product did not need to be coiled at low coiling temperatures to achieve its strengthening potential with the hot rolling. Moreover, the yield and tensile strength levels for the cast niobium steel was not significantly affected by the degree of inline hot rolling with a reduction of at least 19% to 37% as shown in FIG. 7.

Figure 9:
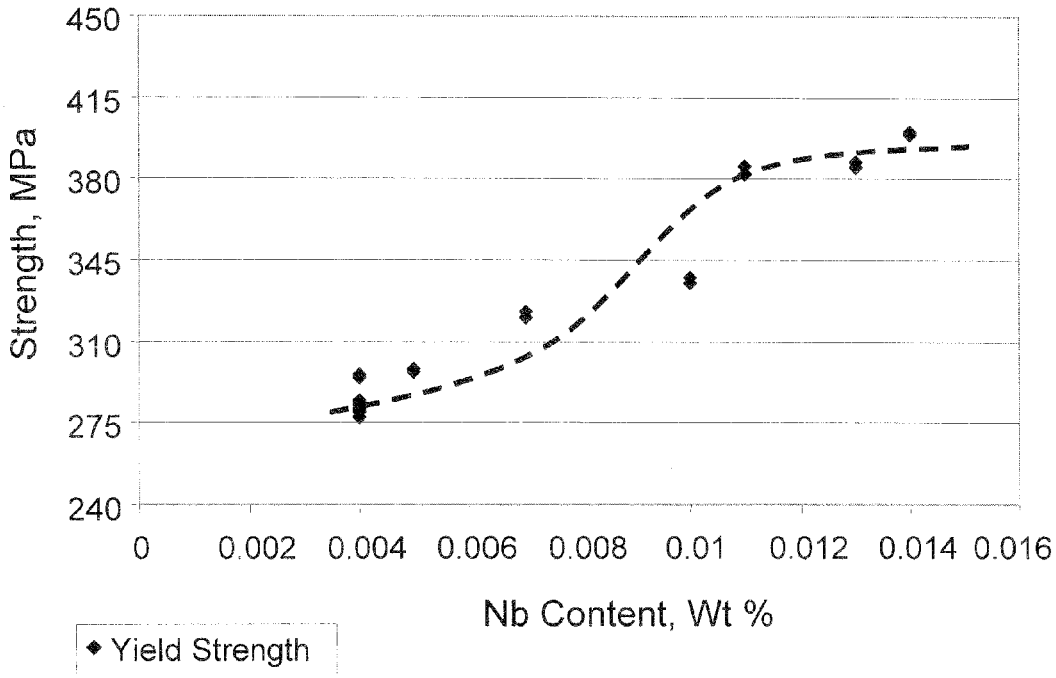
FIG. 9 is a graph showing the effect of niobium amount on the yield strength at low levels of niobium.

The hardenability of the present steels is shown in FIG. 9. As shown in FIG. 9, a niobium level of as little as 0.007% was effective in increasing the strength of the final strip, and yield strength levels of over 380 MPa were achieved with niobium levels greater than about 0.01%. Note that niobium levels less than about 0.005% may be considered residual. Thus even very small additions of microalloying elements can be effective in substantial strengthening.

Figure 4A:
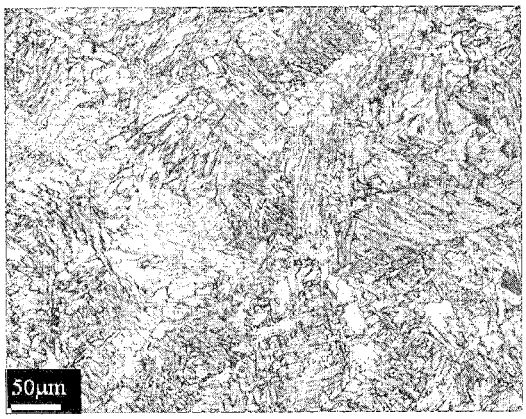
FIG. 4A is an optical micrograph of a niobium steel strip.
Figure 4B:
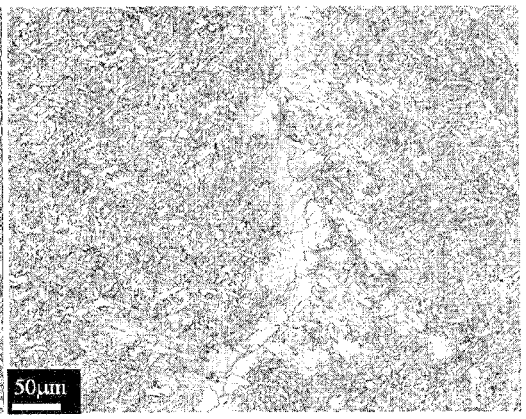
FIG. 4B is an optical micrograph of a standard Structural Steel Grade 380 (Grade 55) steel strip.

The high strengths were achieved by utilizing the niobium microalloying addition to increase the hardenability of the steel through the suppression of the formation of proeutectic ferrite. FIG. 4B shows that proeutectic ferrite formed along the prior austenite grain boundaries (allotriomorphic ferrite) in the base steel, but it was not present in the niobium steel shown in FIG. 4A. The hardenability effects of the niobium addition suppressed the ferrite transformation, hence enabling the stronger bainitic and acicular ferrite microstructure to be produced while using conventional cooling rates during cooling and higher coiling temperatures. The final microstructure of the present niobium steels comprises mostly a combination of bainite and acicular ferrite. The base steel shown in FIG. 4B was cooled to a relatively low coiling temperature, less than 500° C., a cooling condition known to suppress ferrite formation at the austenite grain boundaries.

The effect of hot reduction on yield strength is reduced in the present niobium steel. In previous C—Mn products, there is typically a decrease in strength with increasing hot reduction. In contrast, as shown in FIG. 7, the effect of hot reduction on yield strength is significantly reduced in the present steel product. In this experiment, the coiling temperature was kept constant, and covering the range of hot rolling reductions up to at least 40% represented the strip thickness range of 1.0 mm to 1.5 mm. Unlike the non-microalloyed base steel, the strength levels of the niobium microalloyed steels of the present disclosure in the as-hot rolled cast strip product are relatively insensitive to the degree of hot rolled reduction for reductions up to at least 40%. Further, these high strength levels were achieved using conventional coiling temperatures in the range of 550° C. to 650° C., as shown in FIG. 3.

Figure 10A:
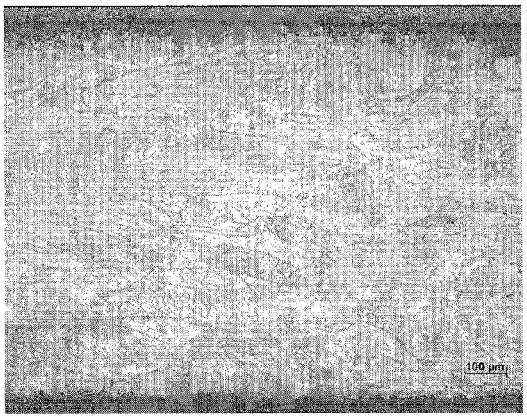
FIG. 10A shows a micrograph of the microstructure of a first sample of 0.065% niobium steel after hot rolling.
Figure 10B:
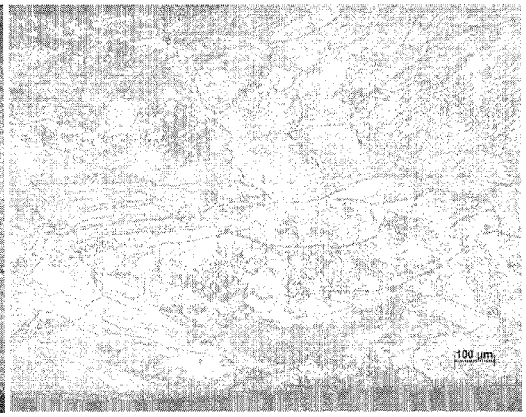
FIG. 10B shows a micrograph of the microstructure of a second sample of 0.065% niobium steel after hot rolling.

To investigate this effect further, the austenite grain size was measured at each thickness in the 0.026 Nb steel. Where the base steel tended to be fully recrystallized above about 25% hot reduction, the 0.026 Nb steel showed only limited recrystallization even at 40% reduction. This indicates that the niobium in solid solution reduced the effect of hot reduction on the strength properties by suppressing static recrystallization of the deformed austenite after hot rolling. This is shown in FIG. 10, where it can be seen that the austenite grains have been elongated by the hot rolling reduction without recrystallising into finer grains. Finer grains increase the austenite grain boundary area, thereby reducing the steel hardenability. However, while recrystallization to a finer austenite grain size was suppressed, such high hot rolling reductions are known to raise the ferrite transformation start temperature. In addition, high hot rolling reduction can induce local high strain regions within the austenite grains, usually referred to as shear bands, which can act as intragranular nucleation sites for ferrite nucleation. In the present steels, the hardenability effect of the niobium was sufficient to suppress the formation of ferrite within the deformed austenite grains, which resulted in strength levels that were largely insensitive to the degree of hot rolling.

The thin cast strip niobium steel product had consistent yield and tensile strength levels over the range of hot rolling applied, and capable of providing a yield strength of at least 410 MPa with a reduction of between 20% and 40%. The prior austenite grain size was determined for each strip thickness. The austenite grain size measurements indicated that only very limited recrystallization had occurred at high hot rolling reductions, whereas in the comparable base steel strip, the microstructure almost fully recrystallized at hot rolling reductions over about 25%. The addition of niobium to the cast steel strip suppressed the recrystallization of the coarse as-cast austenite grain size during the hot rolling process, and resulted in the hardenability of the steel being retained after hot rolling and retention of niobium in solution.

The higher strength of the present steel strip after hot rolling was mostly due to the microstructure formed. As shown in FIG. 4A, the microstructure of the cast niobium steel was comprised of a majority if not mostly bainite for all strip thicknesses. In contrast, as shown in FIG. 4B, the comparable non-microalloyed steel achieved similar strength by coiling at a low coiling temperature and had a microstructure comprising mostly acicular ferrite with some grain boundary ferrite. The addition of niobium to the steel strip provided an increase in the hardenability of the steel and suppressed the formation of the grain boundary ferrite and promoted the bainitic microstructure, even at considerably higher coiling temperatures.

Figure 11:
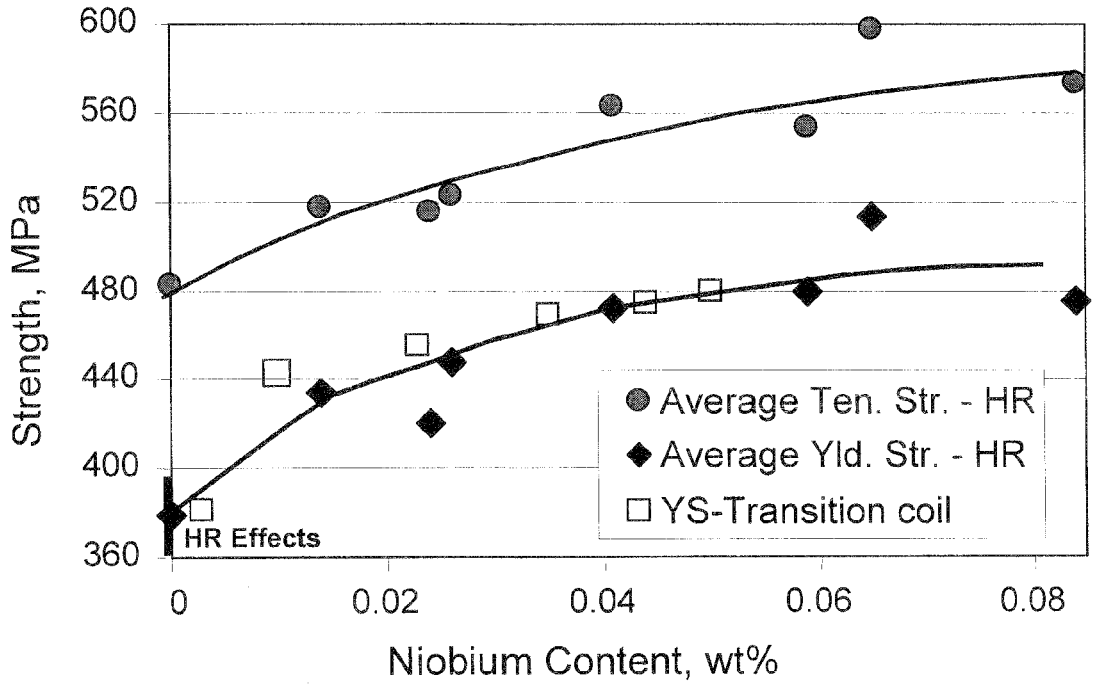
FIG. 11 is a graph showing the effect of niobium amount on the yield strength.
Figure 12:
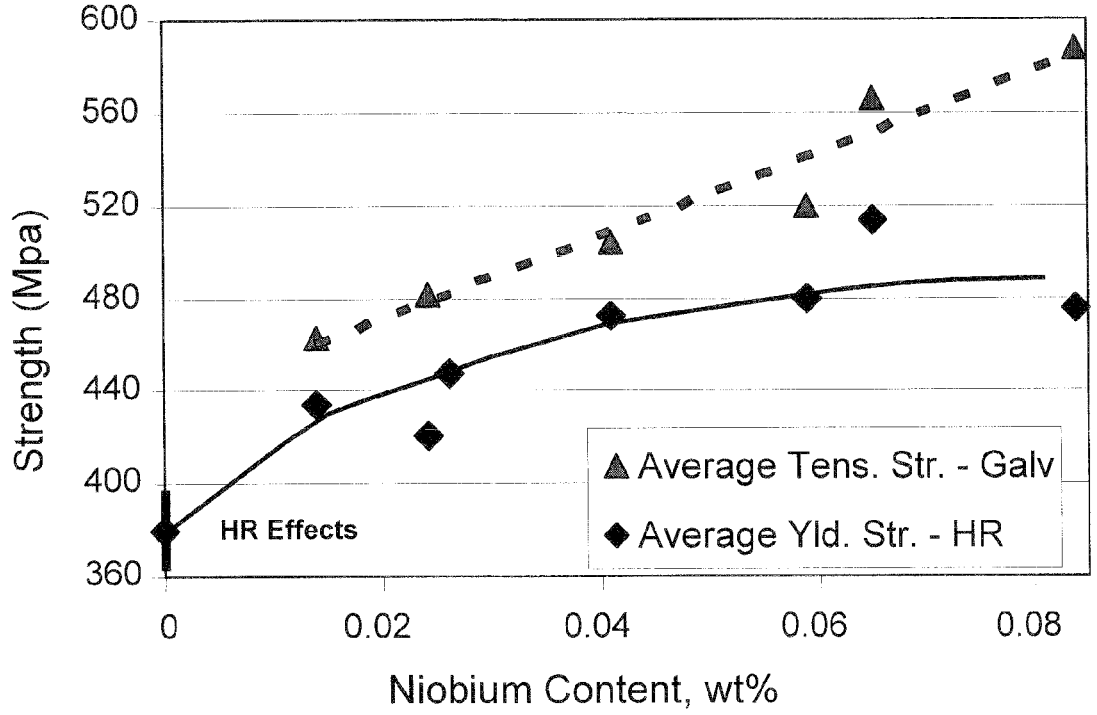
FIG. 12 is a graph showing the effect of niobium amount on the yield strength after hot reduction and galvanizing.

The yield and tensile strength results from the trial steels, shown in Table 2 below, in the as-hot rolled condition are summarized in FIG. 11. The strength level increases with increasing niobium content, with yield strength of at least 340 MPa, with levels up to about 500 MPa in the as-hot rolled condition. The tensile strength may be at least 410 MPa. The initial rapid increase in strength is attributed to the suppression of proeutectic ferrite formation and the promotion of bainite and acicular ferrite, while the subsequent strengthening can be attributed to continued microstructural refinement and possibly solid solution hardening from niobium retained in solid solution.

In addition, transmission electron microscopy (TEM) examination did not reveal any substantial niobium precipitation in the as hot rolled cast strip. This indicates that the niobium had been retained in solid solution and that the strengthening produced was mainly attributed to the enhanced hardenability effect of the niobium resulting in the formation of a majority and likely predominantly bainitic microstructure. The hardenability of the cast steel strip is also believed to be enhanced by the retention of coarse austenite grain produced during formation of the cast strip. The transformation to bainite, rather than ferrite, is believed to be a major factor in suppressing the precipitation of the microalloy addition of niobium in the thin cast strip during cooling of the coil from the coiling temperature.

The transmission electron microscopy (TEM) examination may be used to determine the size, identity and volume fraction of niobium carbonitride particles present in the steel. The absence of any niobium carbonitride particles upon TEM examination supported the view that the observed strength was largely attributable to the microstructure being largely bainite rather than ferrite. The subsequent observed strengthening increment arising from an age hardening heat treatment therefore leads to the conclusion that niobium had been substantially in solution in the hot rolled strip. After determining the volume fraction of carbonitride particles in the microstructure using TEM analysis, the amount of microalloy element in solid solution can be concluded.

Thin foils or carbon replicates may be evaluated by TEM in determining the amount of the present carbonitride particles. In our analysis, a JEOL 2010 transmission electron microscope was used. However, from our experience with this instrument, Nb particles below 4 nanometers may not be resolvable in heavily dislocated ferrite.

For thin foil analysis, a foil is prepared. The foil is cut and ground to a thickness of 0.1 mm. The sample is then thinned to electron transparency by electro-polishing using a 5% perchloric acid, 95% acetic acid electrolyte in a Tenupole-2 electro-polishing unit. The sample can then be directly transferred to the TEM.

For carbon replication, a desired sample may be prepared by etching a polished sample in Nital (a solution of alcohol and nitric acid) after etching, coating the samples with carbon, and then scoring the carbon coating into appropriate dimensions (for example 2 mm square) for TEM analysis. After scoring, carbon replicas may be liberated from the sample by dissolving the ferrite matrix in 3% Nital. The carbon replica samples are collected on 3 mm diameter support grids, then repeatedly washed in ethanol/water solutions. The carbon extraction replica with the supporting grid can then be transferred to the TEM.

An additional factor believed to account for the absence of niobium carbonitride particles in the hot rolled cast strip relates to the nature of the dispersion of niobium with the rapid solidification of the strip during its formation by the method of continuously making cast strip described. In previously made microalloyed high strength strip, relatively long time intervals were involved in the solidification with slab cooling, slab reheating and thermo-mechanical processing that permitted opportunities for pre-clustering and/or solid state precipitation of carbonitride particles such as (Nb, V, Ti, Mo) (CN), that enabled the kinetics for subsequent precipitation through the stages of the manufacturing process. In the present process described, where the cast strip is continuously formed from a casting pool between casting rolls, the extremely rapid initial solidification in forming the cast strip (in about 160 microseconds) is believed to inhibit pre-clustering and/or solid state precipitation of carbonitride particles, and in turn, slow and reduce the kinetics for precipitation of the microalloys in subsequent processing including rolling and coiling operations. This means that the microalloys of Nb, V, Ti, and Mo are relatively more evenly distributed in the austenite and ferrite phases, than in thin steel strip previously made by conventional slab casting and processing.

Atom probe analysis of niobium cast strip made by forming from a casting pool between casting rolls as above described has verified the more even distribution of microalloys (indicating reduced pre-clustering and/or solid state precipitation) in both the as cast and the hot rolled strip when coiled at about 650° C. or lower. This more even distribution of elements is believed to be inhibiting the formation of carbonitrides in the coiling operation under conditions where fine coherent precipitation of such elements occurred in previous conventionally made and processed microalloyed slab cast steel. The reduction or absence of pre-clustering and/or solid state formation of carbonitrides in the microalloyed cast strip made by twin roll casting also slows the kinetics of formation of carbonitrides during subsequent thermo-mechanical processing such as annealing. This then permits the opportunity for age hardening at temperatures higher than those where the particles in previously conventionally processed strip lost their strengthening capacity through coarsening (Ostwald ripening) mechanisms.

With an age hardening heat treatment, higher tensile strength was found to be achievable. For example, with a 0.026% niobium addition, an increase of at least a 35 MPa (about 5 ksi) increase in yield strength from 410 to 450 MPa (about 60-65 ksi) was observed. With a 0.05% niobium addition, it is contemplated that with an age hardening, an increase of at least 10 ksi is expected, and a with 0.1% niobium addition, it is contemplated that with an age hardening, an increase of at least 20 ksi is expected. The microstructure of the present age hardened steel product may have niobium carbonitride particles with an average particle size of 10 nanometers and less. The microstructure of the age hardened steel product may have substantially no niobium carbonitride particles greater than 50 nanometers.

Figure 5:
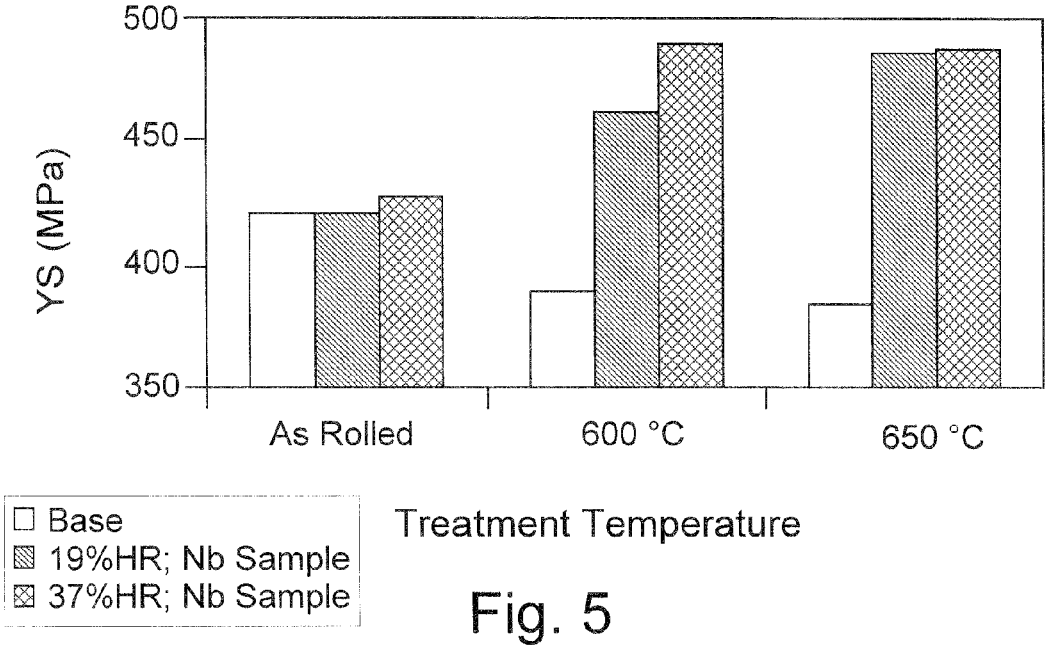
FIG. 5 is graph showing the effect of post coil age hardening on yield strength of the present steel strip.

Laboratory ageing heat treatments were conducted on samples of 0.026% niobium steels at various temperatures and times to induce action of the niobium, that was believed retained in solid solution in the hot rolled strip. As shown in FIG. 5, ageing heat treatments produced a significant increase in strength, with yield strengths of about 480 MPa (about 70 ksi). This confirmed that the niobium was retained in a solid solution and was available to provide age hardening on subsequent ageing, for example, through the use of an annealing furnace on continuous galvanizing lines or by using a continuous annealing line. Accordingly, short time age hardening is carried out to simulate the ageing potential from processing the niobium microalloyed cast steel product through an annealing furnace attached to continuous galvanizing line or conventional continuous annealing line. In the latter case the age hardened high strength strip product maybe subsequently galvanized, painted or utilized uncoated.

Figure 6:
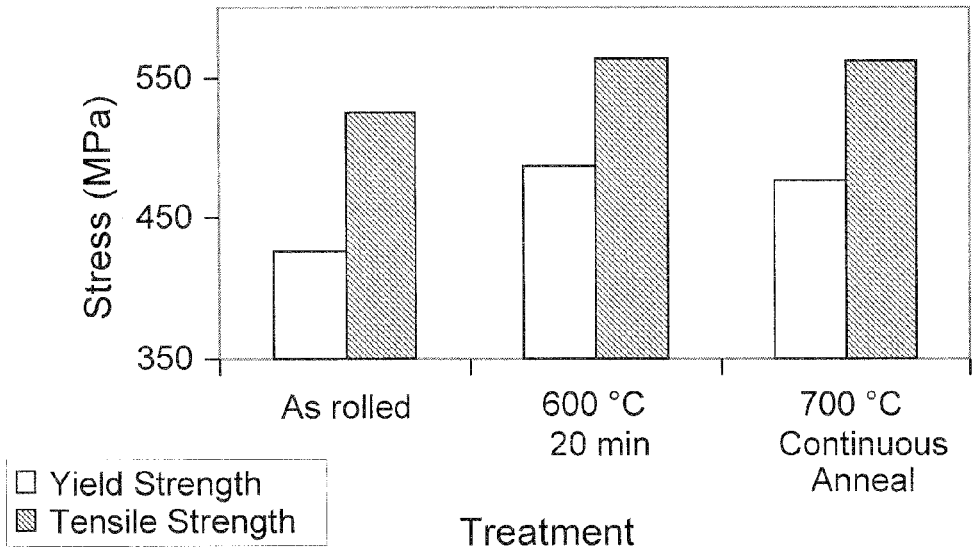
FIG. 6 is a graph showing the effect of post coiling simulated age hardening cycle on yield and tensile strength of the present steel strip.

The results, as shown in FIG. 6, clearly show that for a peak processing temperature of 700° C. (1292° F.), significant strengthening was realized, with strength levels approaching that achieved for the longer times at lower temperatures. The tensile properties of the niobium thin cast steel product after the short time ageing treatment using a peak temperature of 700° C. (1292° F.) are given in Table 1. Besides the high strength of the cast strip product, the ductility and formability is satisfactory for structural quality products. The cast strip product produced is a thin, high strength strip product for structural applications through the use of niobium microalloying. It is contemplated that higher microalloying levels would realize even higher yield strengths, potentially well in excess of 550 MPa (about 80 ksi).

TABLE 1

| Strip Thickness, mm | Yield Strength, MPa | Tensile Strength, MPa | Total Elongation, % | YS/TS | 'n' Value | 'r' Value |
|---|---|---|---|---|---|---|
| 1.1 | 477 | 563 | 18 | 0.85 | 0.12 | 0.90 |

Recently, in addition to producing the 0.026 wt % niobium steel, steels with niobium additions of 0.014 wt % and 0.065 wt % have been successfully produced via the present process. Heat compositions are shown below in Table 2.

TABLE 2

| Steel | C (wt %) | Mn (wt %) | Si (wt %) | Nb (wt %) | V (wt %) | N (ppm) |
|---|---|---|---|---|---|---|
| A | 0.032 | 0.72 | 0.18 | 0.014 | <0.003 | 78 |
| B | 0.029 | 0.73 | 0.18 | 0.024 | <0.003 | 63 |
| C | 0.038 | 0.87 | 0.24 | 0.026 | <0.003 | 76 |
| D | 0.032 | 0.85 | 0.21 | 0.041 | <0.003 | 65 |
| E | 0.031 | 0.74 | 0.16 | 0.059 | <0.003 | 85 |
| F | 0.030 | 0.86 | 0.26 | 0.065 | <0.003 | 72 |
| G | 0.028 | 0.82 | 0.19 | 0.084 | <0.003 | 85 |
| H | 0.025 | 0.92 | 0.22 | <0.003 | 0.043 | 75 |
| I | 0.032 | 0.92 | 0.22 | 0.038 | 0.042 | 60 |
| Base Steel Comparative Sample | 0.035 | 0.85 | 0.27 | <0.003 | <0.003 | 60 |
| Base Steel Typical | 0.02-0.05 | 0.7-0.9 | 0.15-0.30 | <0.003 | <0.003 | 35-90 |

The molten compositions of Steels A through I had a free oxygen content between 41 and 54 ppm and within the ranges of 20 to 70 ppm or of 30 and 55 ppm. The total oxygen was more than 70 ppm and typically less than 150 ppm.

Figure 13:
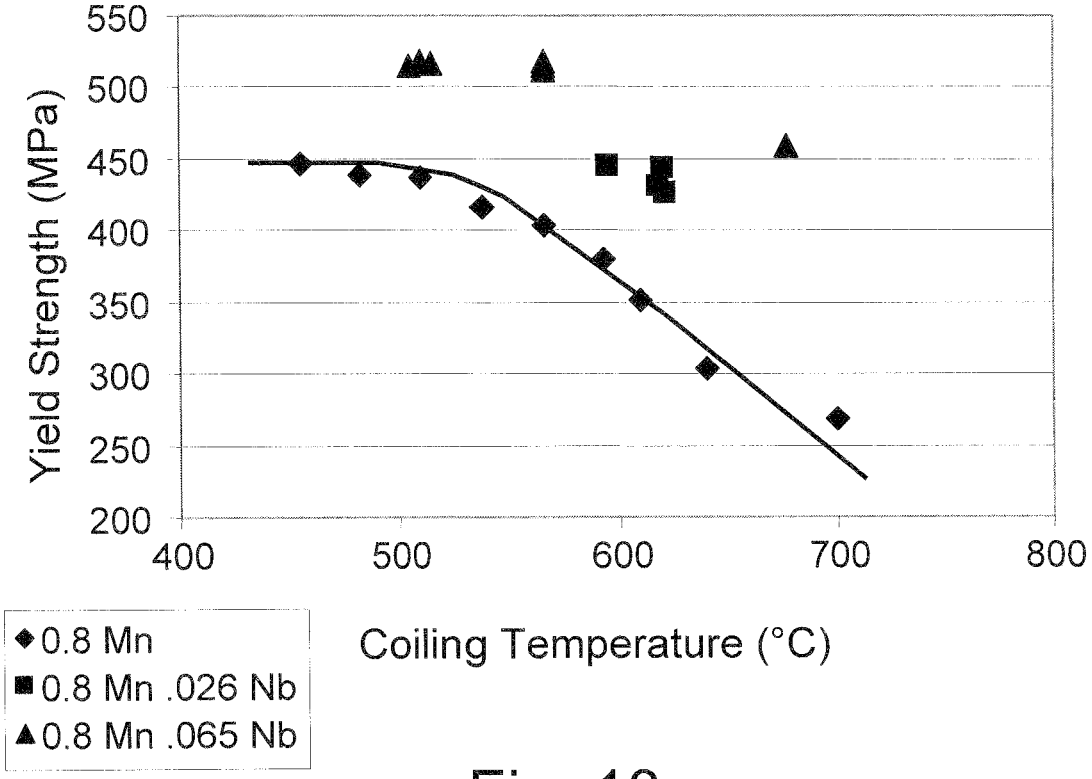
FIG. 13 is a graph showing the effect of coiling temperature on the yield strength.
Figure 14:
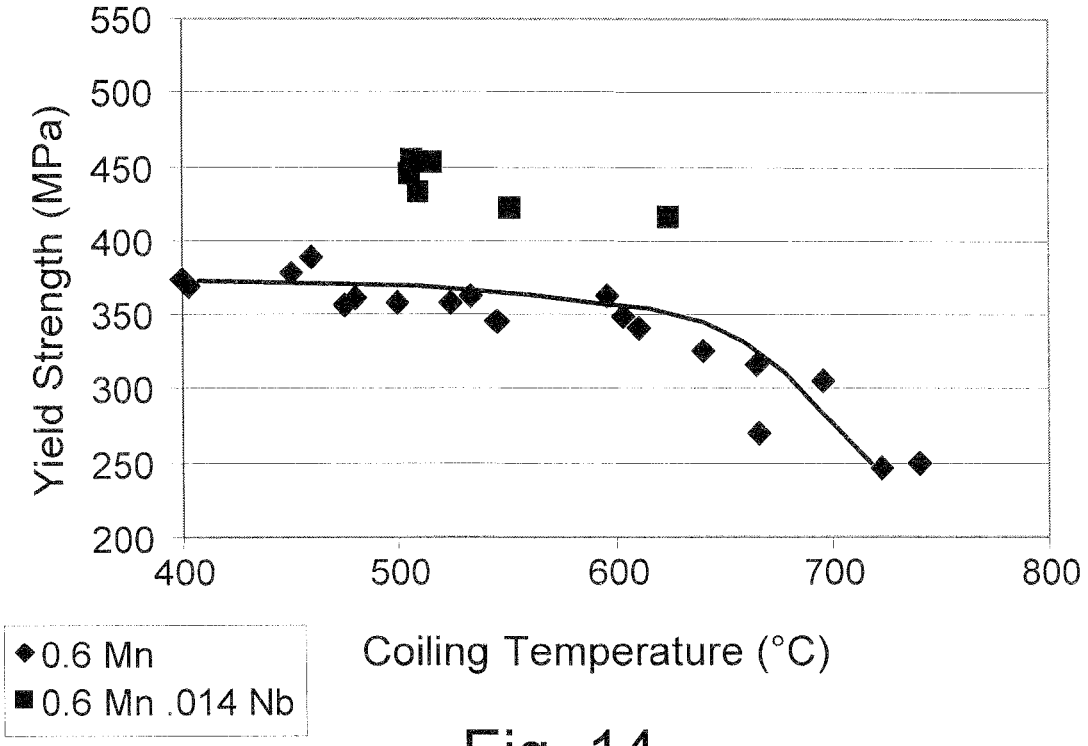
FIG. 14 is a graph showing the effect of coiling temperature on the yield strength at low niobium levels.

The yield strengths achieved for steel C and steel F are shown in FIG. 13, and the yield strength results for the 0.014% Nb heat, steel A, produced with a lower Mn content, are presented in FIG. 14. The niobium additions increased the yield strength at all coiling temperatures relative to the base steel composition. The yield strength increased by about 70 to 100 MPa (10 to 15 ksi) for the 0.014% Nb and 0.026 Nb additions, and by about 140 to 175 MPa (20-25 ksi) for the 0.065 Nb addition. From FIG. 13 it can be seen that the 0.026% Nb steel achieved higher yield strengths than the 0.8 Mn base steel for similar coiling temperatures, and comparable yield strengths to when the 0.8 Mn base steel was coiled a low temperatures. Alternatively, the strengths achieved in the 0.8 Mn base steel at low coiling temperatures (about 500° C.) can be achieved at higher coiling temperatures (about 600° C.) with this Nb addition.

Additionally, in contrast to previous conventionally produced microalloyed steel, we have found that the microalloy addition suppresses the formation of carbonitride particles in the hot rolled and subsequently coiled and cooled steel. Instead, the microstructure of the hot rolled and subsequently coiled and cooled steel comprises bainite and acicular ferrite with more than 70% niobium and/or vanadium remaining in solid solution. Alternatively, the microstructure of the hot rolled and subsequently coiled and cooled steel may comprise bainite and acicular ferrite with more than 80% niobium and/or vanadium remaining in solid solution, and alternatively may have more than 90% remaining in solid solution.

Thus, it has been shown that the niobium cast strip results in light gauge, high strength, steel product. The niobium addition firstly is capable of suppressing the austenite recrystallization during hot rolling, which enhances the hardenability of the steel by retaining the relatively coarse as cast austenite size. The niobium being retained in solid solution in austenite after hot rolling, directly increases the steel's hardenability, which assists in transforming the austenite to a final microstructure comprised mostly of bainite, even at relatively high coiling temperatures. The formation of a bainitic microstructure promoted the retention of the niobium addition in solid solution in the hot rolled strip.

Further improvement in properties may be obtained by age hardening the present steels. In previous microalloyed and non-microalloyed steels, an increase in strength could be obtained by age hardening, but in such prior steels, a decrease in elongation occurs with an increase in strength. We have found that both an increase in elongation and an increase in strength may be obtained by age hardening the present steels.

It was determined that the retention of the microalloying elements such as niobium and vanadium in solid solution by the prior processing conditions provided considerable hardenability for subsequent age hardening cycle. Such an age hardening cycle can be produced using a suitable continuous galvanizing line or continuous annealing facility. Hence a microalloyed steel strip made using a thin strip casting process, combined with an age hardening heat treatment provided by a suitable galvanizing line or annealing line, is a unique manufacturing path providing a unique strengthening approach for this type of steel product.

For example, in a conventional continuous hot dip galvanizing line, coils are lap welded at an entry end to ensure continuous operation. The steel then proceeds through a cleaning section, such as an alkalai cleaner. The initial pre-heating section of the furnace may be about 20 meters in length, reaching a steel temperature between about 400 and 600° C., or higher as desired. This section may be heated by open burners in an ambient air atmosphere. Then, a closed radiant tube section may be about 10 meters in length having a hydrogen-nitrogen atmosphere heating the steel to between about 600 and 800° C., as discussed below. The strip is then jet cooled to the pot immersion temperature (450-480° C.). The strip is subsequently run through the cooling tower, and may pass through an in-line skin pass and/or tension leveller, and then coiled at the exit end of the line at a desired coiling temperature. The galvanizing and age hardening process may use conventional line speeds such as about 60-100 m/min, and processing conditions appropriate for the strip thickness and coating weight. The hot dip coating may be a zinc coating or a zinc alloy coating such as a zinc-aluminium coating.

Figure 15:
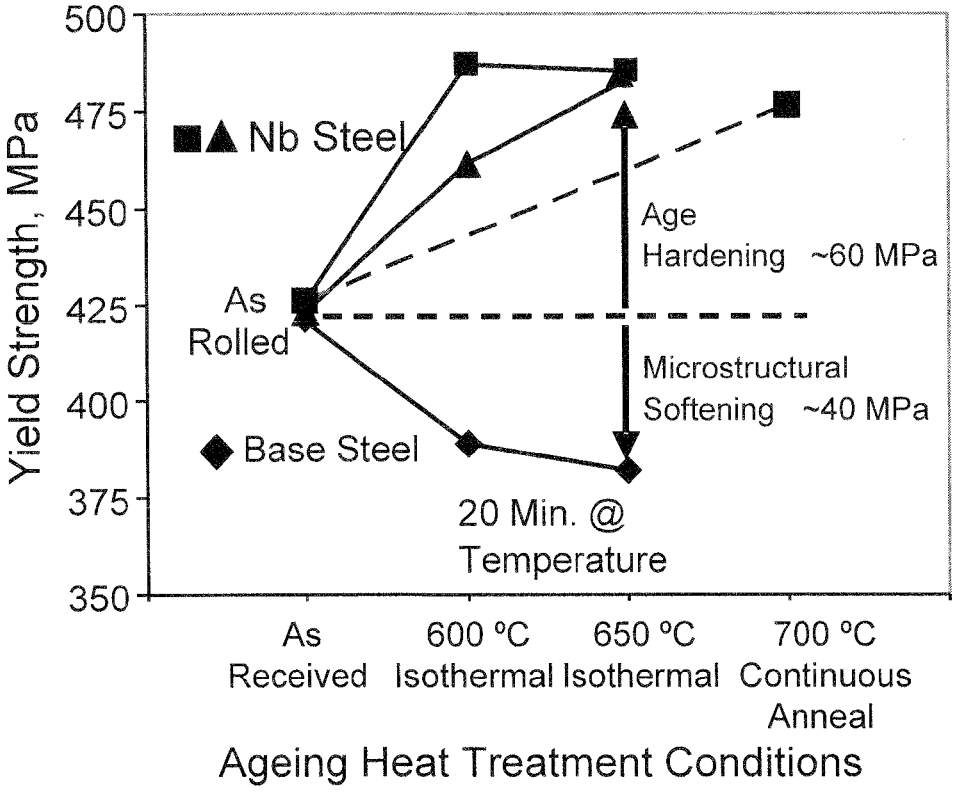
FIG. 15 is a graph showing the effect of heat treating conditions on the yield strength.
Figure 16:
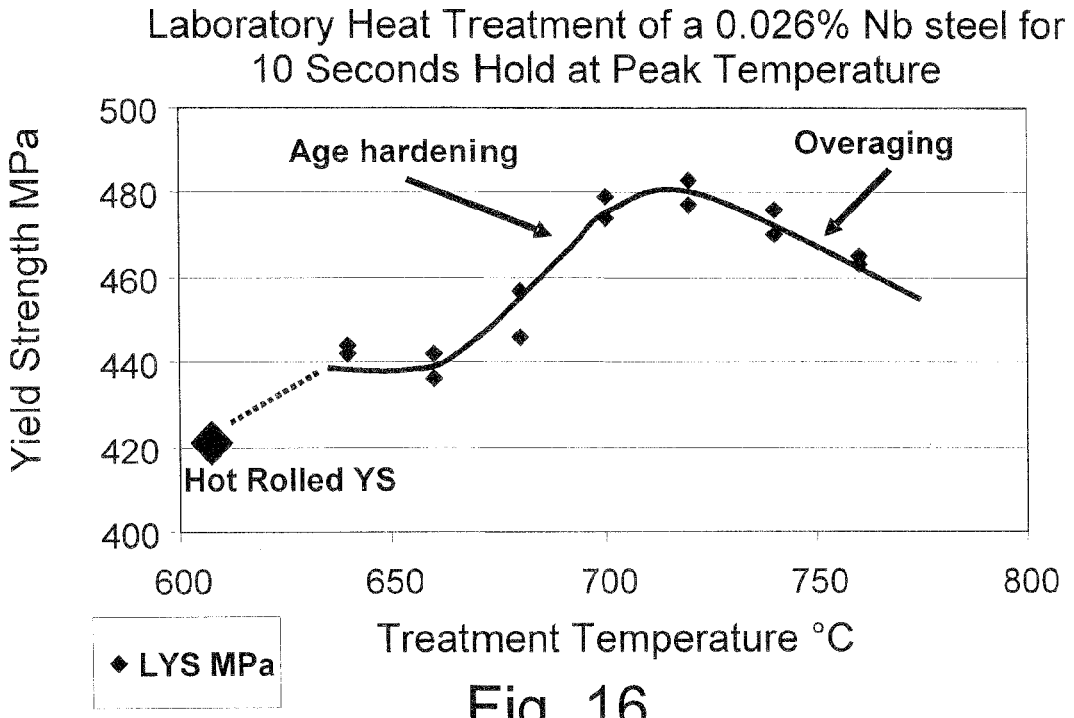
FIG. 16 is a graph showing the effect of age hardening heat treating temperature on the yield strength of 0.026% niobium steel.

Isothermal ageing treatments of the hot rolled 0.026% Nb cast strip material were carried out for 20 minutes at 600° C. and 650° C. (1110° F. and 1200° F.), inducing formation of niobium carbonitrides, or Nb(C,N), as confirmed by TEM examination. This resulted in an increase in yield strength of the material, as shown in FIG. 15. Also, as shown in FIGS. 6 and 15, the thermal cycle of strip through the annealing section of a galvanizing line also induced a significant strength increase, approaching that achieved with the isothermal aging at lower temperatures.

The increase in the hardenability provided by the microalloy addition through the suppression of the ferrite transformation significantly lowers the austenite decomposition temperature into the bainite/acicular ferrite temperature range. This lower transformation start temperature provides the potential to retain the vast majority of the microalloy addition in solid solution by applying conventional run out table cooling rates and appropriate coiling temperatures.

The microalloying elements, such as niobium and vanadium, in solid solution are available for age hardening during a subsequent heat treatment to increase strength. Laboratory age hardening studies established that substantial strengthening could be achieved even with relatively short heat treatment cycles, such as available with continuous annealing lines and galvanizing lines. The results from laboratory simulated continuous annealing cycles applied to trial Steel C (0.026% Nb), Steel F (0.065% Nb), and Steel G (0.084% Nb) are shown in FIGS. 16 through 19.

Figure 21:
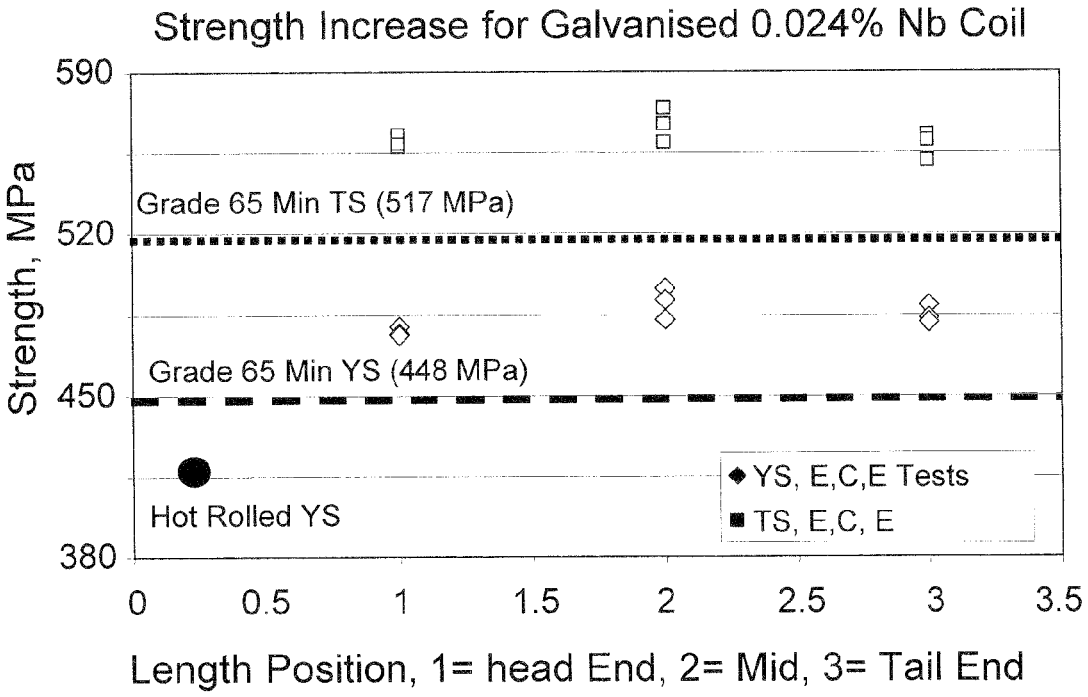
FIG. 21 is a graph showing heat treating variation for coils after continuous annealing by galvanizing.
Figure 22:
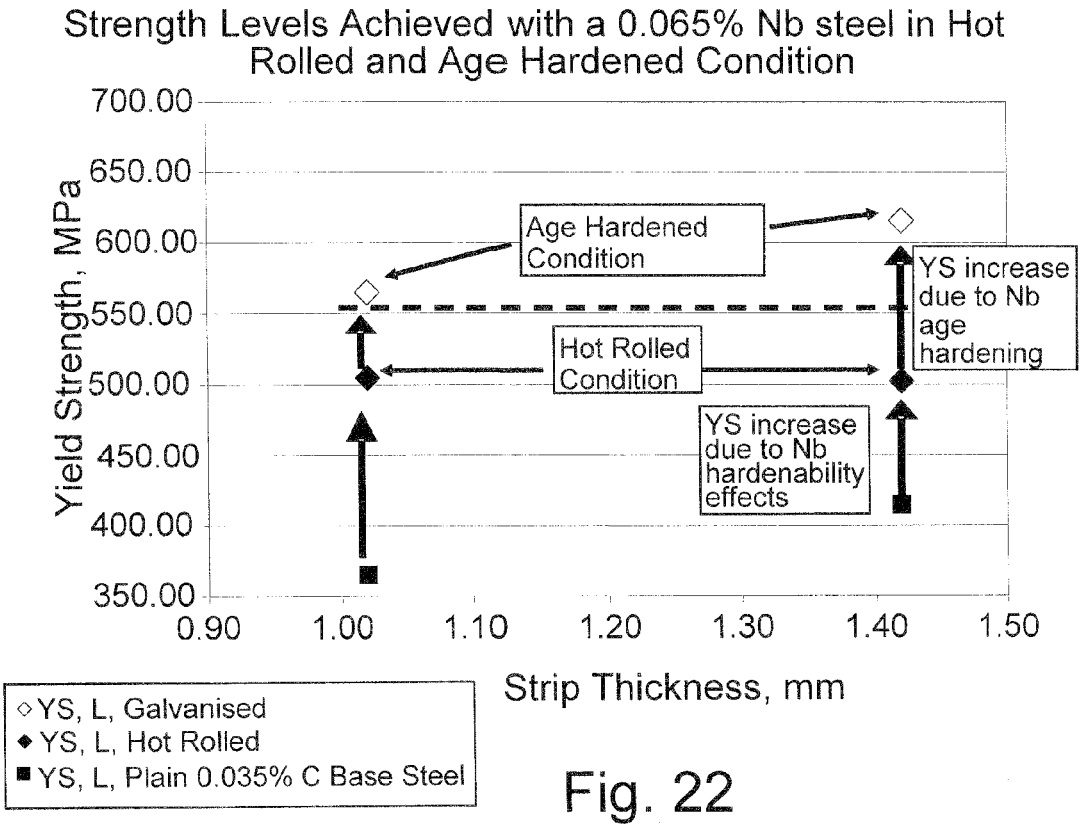
FIG. 22 is a graph showing age hardened condition.

The results from full scale plant trials with steels B and F, using the heat treatment conditions established from the laboratory study are given in FIGS. 21 and 22, respectively. Substantial strength increases were achieved with steels B and F. Yield strength levels in excess of 450 MPa were recorded with the 0.024% Nb steel (steel B) and yield strengths over 550 MPa with the 0.065% Nb steel (steel F). Strength increase from the age hardening was in the order of 70 MPa (10 ksi) for the 0.024% Nb steel (steel B) and up to about 100 MPa (15 ksi) for the 0.065% Nb steel (steel F). It is contemplated that the 0.065% Nb steel may achieve yield strengths over 600 MPa in the age hardened condition.

TABLE 3

| Steel F | Thickness mm | Yield Strength MPa | Tensile Strength MPa | Elongation % |
|---|---|---|---|---|
| Hot band | 0.996 | 512 | 599 | 11.47 |
| Galvanized | 0.991 | 581 | 645 | 14.16 |

Figure 20:
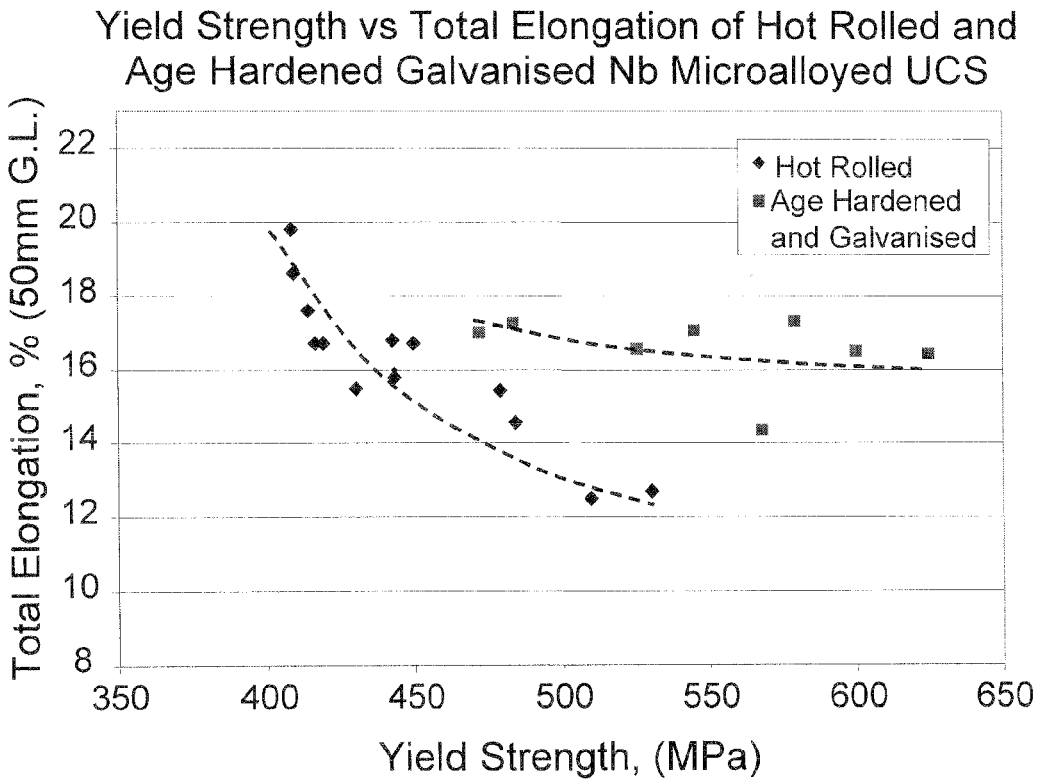
FIG. 20 is a graph showing the effect of yield strength on elongation before and after age hardening.

Samples of steel F were age hardened on using the age hardening conditions found on a galvanizing line. As shown in TABLE 3, the age hardened steel had a strength of almost 70 MPa, and the elongation increased from 11.47% to 14.16%. The relationship between yield strength and total elongation for the presently disclosed niobium steels in the as hot rolled condition and in the age hardened and galvanized condition (longitudinal test direction) is shown in FIG. 20.

Figure 17:
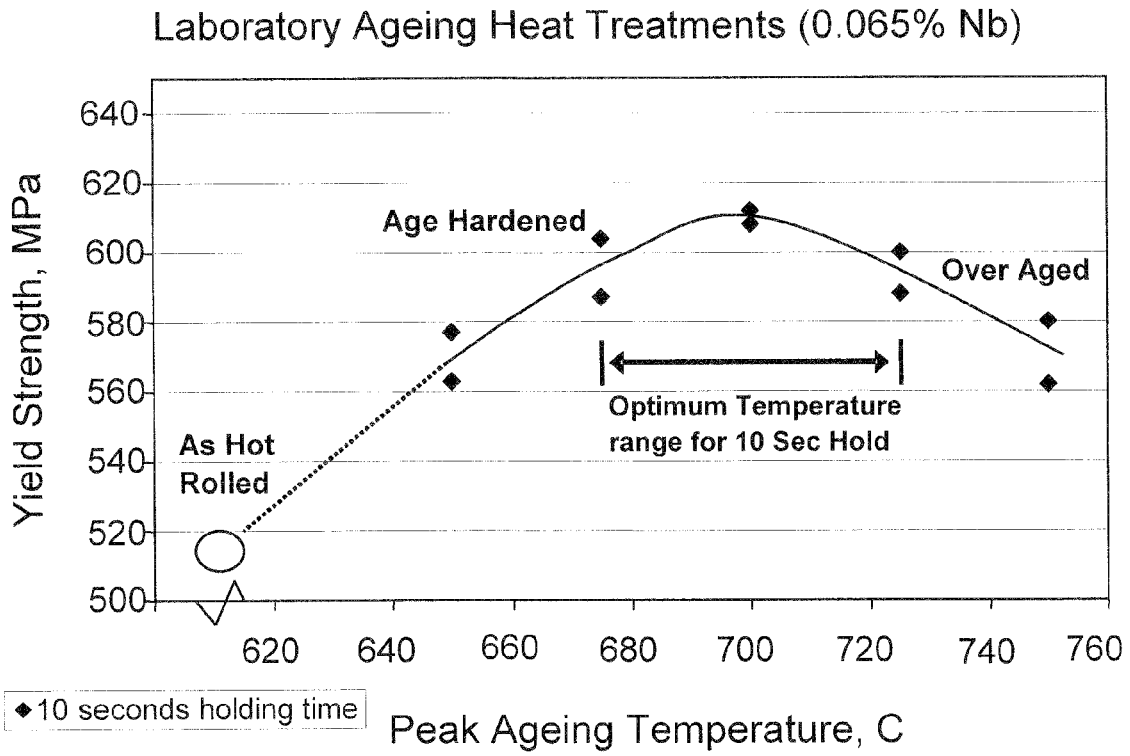
FIG. 17 is a graph showing the effect of peak aging temperature on the yield strength of 0.065% niobium steel.
Figure 18:
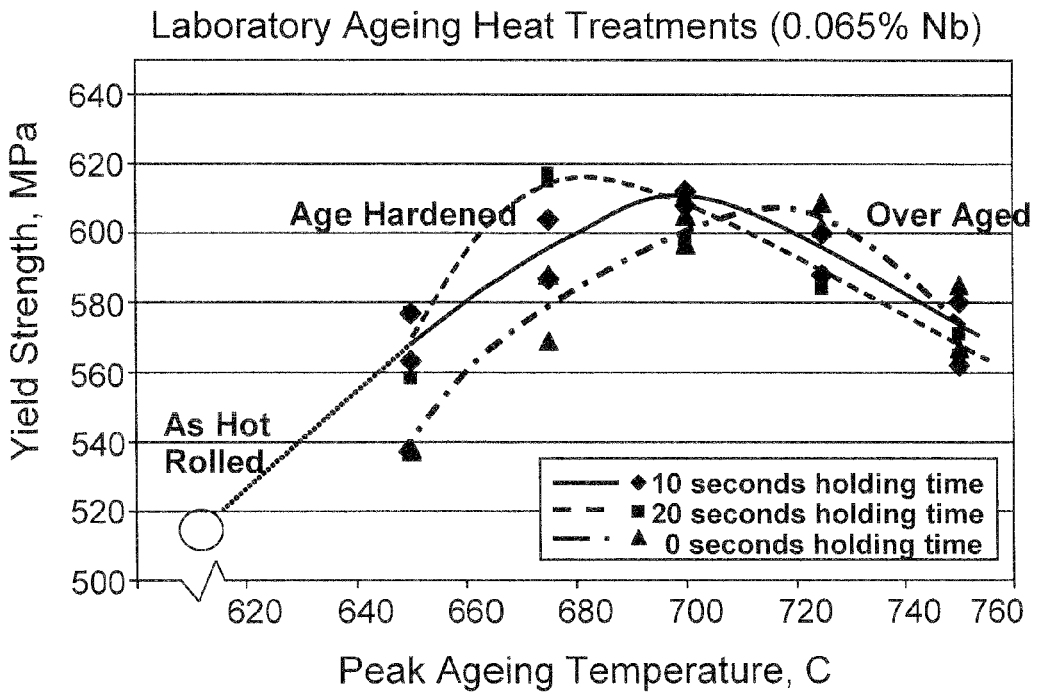
FIG. 18 is a graph showing the effect of peak aging temperature and hold time on the yield strength of 0.065% niobium steel.
Figure 19:
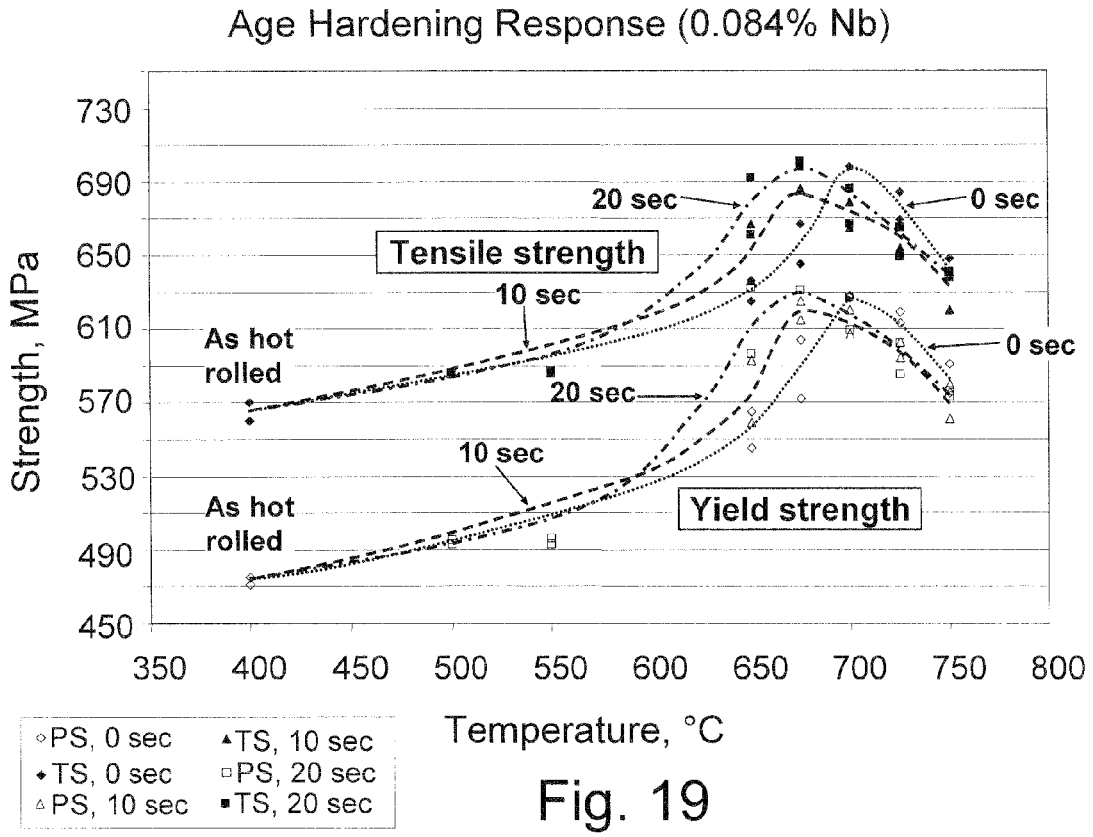
FIG. 19 is a graph showing the effect of peak aging temperature and hold time on the yield strength for 0.084% niobium steel.

As shown in FIG. 17, we have found that a 10 second hold cycle may be used between about 675° C. to 725° C. to prevent overaging. However, the temperature range is a function of the holding time. Increasing the hold time to 20 seconds lowered the temperature range slightly, while for the zero hold time, the temperature range was increased slightly, as shown in FIG. 18. The age hardening temperature range may be between about 625° C. and 800° C. depending upon on the overall heat treatment cycle time, i.e. heating rates, the holding time, and cooling rates.

Figure 23:
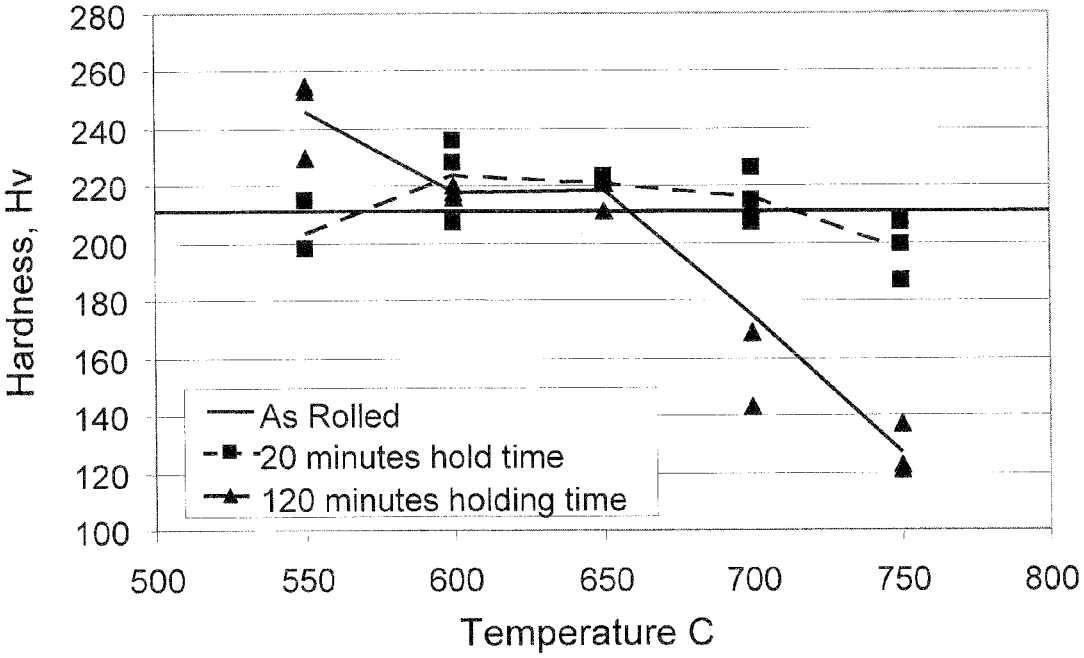
FIG. 23 is a graph showing the effect of temperature and time on hardness.

In the case of longer time heat treatments, lower temperatures in the range of 500° C. to 650° C. may be used. From FIG. 6 it can be seen that a heat treatment of 20 minutes at 600° C. produces similar strength levels as 10 seconds in a continuous annealing cycle at 700° C. FIG. 23 shows results of laboratory heat treatments carried out for 20 and 120 minutes. The results show that substantial hardening was achieved for a heat treatment of 120 minutes at 550° C., but the 120 minute aging at temperatures over about 650° C. reduced the hardness of the steel. Longer heat treatment times could be used with full coil annealing processes, such as batch annealing in the temperature range of 500° C. to 650° C., or other post coiling cooling practices for the hot rolled coil, designed to precipitate the retained niobium, by controlled cooling through the temperature range 500° C. to 650° C.

Transmission electron microscopy (TEM) was carried out on samples of steels C and F, which had been given a heat treatment of 60 minutes at 650° C. Fine particles in the size range of 4 to 15 nanometers were found. These fine particles were found to include niobium carbonitrides, indicating that the strengthening may be attributed to age hardening by fine niobium carbonitride particles.

The microstructure of the age hardened microalloyed steel product may have niobium carbonitride particles, with an average particle size of 10 nanometers and less. The microstructure of the age hardened steel product may have substantially no niobium carbonitride particles greater than 50 nanometers. Samples of the present niobium steel in the hot rolled condition were inspected using TEM evaluation, and portions of the microstructure had no measurable amount of niobium carbonitride particles before age hardening.

We believe that the enhanced strength/elongation relationship in the present age hardened steel may be due to portions of the microstructure being substantially free of particles greater than 5 nanometers in size, or "precipitate free zones," and nano-clusters. The development of precipitate free zones in the vicinity of grain boundaries may influence the strength and tensile elongation relationship by providing reduced hardness regions adjacent to grain boundaries. The relaxation of stress concentrations in precipitate free zones has been reported to enhance strength and elongation. The beneficial effects of precipitate free zones on elongation and strength may appear in circumstances where the precipitate free zones are narrow and the size of grain boundary precipitates is small.

In the present steel, the element additions may provide for increased elongation with increased strength after age hardening by producing smaller precipitate free zone width and smaller change in hardness than in conventionally produced niobium steels. Because of the more even dispersion of elements in rapidly solidified steels, the kinetics of age hardening can be retarded so as to effectively expand the time-temperature window over which the formation of nano-clusters can be stably controlled. The element nano-clusters may provide strengthening in the early stages of age hardening. Cluster strengthening may be due to the extra energy required for dislocations to cut the diffuse boundary of the cluster of solute species. The clusters may provide substantial strengthening without reducing ductility because their elastically soft boundaries do not severely inhibit dislocation movement or cause pile-ups in the way that normal second phase particles do.

In the present steels, a more even distribution of elements remains in solid solution during the rapid solidification of steel. In contrast to previous conventionally produced niobium and vanadium steels, the microstructure of the hot rolled and subsequently coiled and cooled steel comprises bainite and acicular ferrite with more than 70% niobium and/or vanadium addition remaining in solid solution and substantially no niobium carbonitride particles greater than 50 nanometers. Alternatively, the microstructure of the hot rolled and subsequently coiled and cooled steel may comprise bainite and acicular ferrite with more than 80% niobium and/or vanadium addition remaining in solid solution, and alternatively may have more than 90% remaining in solid solution.

The elements remain trapped in solution in the hot rolled coil and do not precipitate if the coiling temperature is below about 650° C. Formation is effectively retarded because the prior associations of atoms (such as in the form of particles) that normally occur in conventional slab casting and reheating for hot strip rolling are prevented in the present process. The observed increase in strength that occurs in the hot rolled coils may thus be largely attributable to hardenability and solid solution hardening effects.

Formation of carbonitride particles can be activated during heat treatment. Additionally, during age hardening, pre-precipitation clusters and finer particles are stable over an extended range of time and temperature because of the significant amount of niobium and/or vanadium in solid solution prior to age hardening. The precipitate free zones that form near grain boundaries as a normal precipitation phenomenon are narrower and contain more evenly dispersed nano-clusters and finer precipitates than for conventionally produced steels. Thus the hardness changes in the precipitate free zones relative to the grain interior are relatively small for the present steels. We believe that narrower precipitate free zones and small hardness changes across precipitate free zones reduce stress concentrations in the precipitate free zones reducing microcracking from preferential deformation in the precipitate free zones. We believe that the cluster strengthening may be characterized by a strength increase without a deterioration in ductility since dislocation pile-up does not occur at clusters. The combination of narrow precipitate free zones and cluster strengthening mechanisms is believed to lead to precipitate free zones of the present steels. This results in improved elongation because cracks are more difficult to initiate and less constrained to the grain boundary precipitate free zone region. Further, the nano-clusters may co-exist with distinct particles within the grain interior regions over a certain annealing temperature/time combinations.

An annealing furnace may be used to perform the age hardening, which is not a current strengthening approach for processing such products. The annealing condition may be a continuous annealing cycle with a peak temperature of at least 650° C. and less than 800° C. and better 675° C. to 750° C. Alternatively, strengthening may be achieved in a production environment using a very short age hardening cycle available with conventional annealing furnaces incorporated in continuous galvanizing lines. The final strength levels recorded in the full scale plant trials were similar to that produced with the laboratory heat treatments of the respective steels.

Similar results are contemplated with niobium between about 0.01% and about 0.20%, as well as with titanium between about 0.01% and about 0.20%, molybdenum between about 0.05% and about 0.50%, and vanadium between about 0.01% and about 0.20%. For example, the vanadium may be in the range of about 0.01% and 0.09%. Alternatively, a combination of niobium and vanadium may be used, such as niobium between about 0.01% and 0.09% and vanadium between about 0.01% and 0.09%.

The composition of the present steel utilizing vanadium is shown as steels H and I in Table 2. Steels D, H and I included similar amounts of vanadium and/or niobium, at about 0.04%, to assess vanadium individually and in a dual microalloying system. Again, the molten steel cast has a free oxygen content between 20 and 70 ppm and the free oxygen content may be between 30 and 55 ppm. Again, the total oxygen levels were between 70 ppm and 150 ppm.

Figure 25:
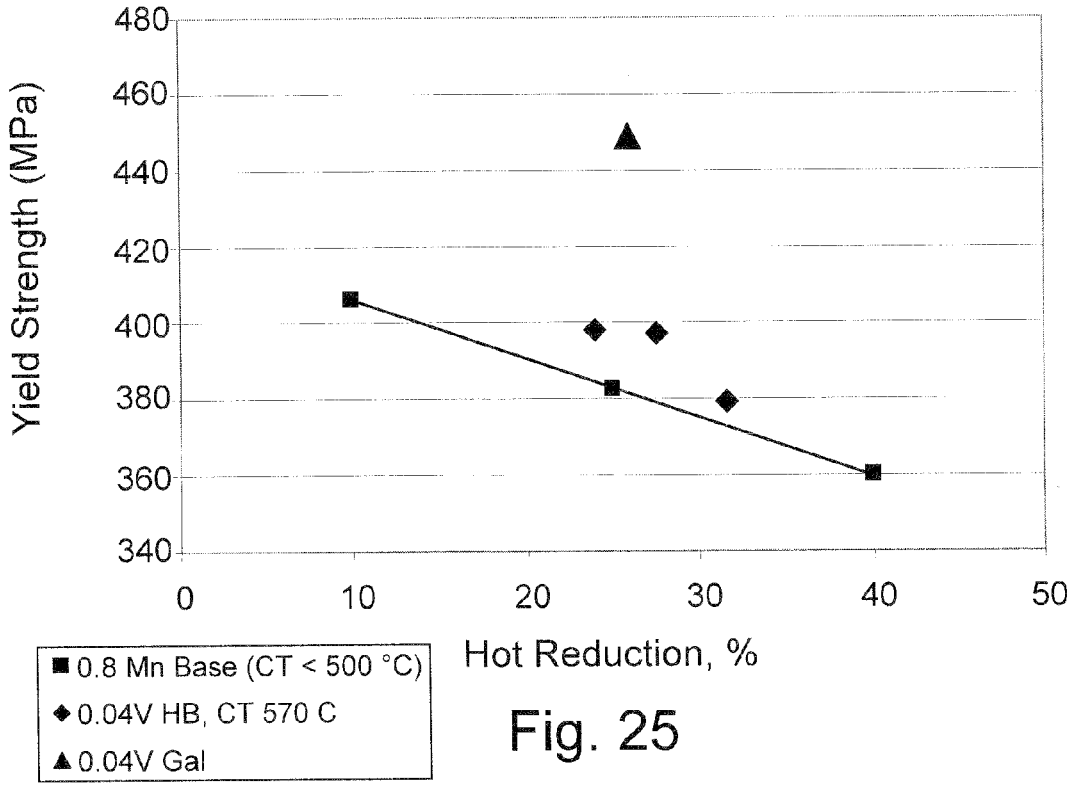
FIG. 25 is a graph showing the effect of hot rolling reduction on the yield strength for the present vanadium steel compared to plain low carbon steel.
Figure 26:
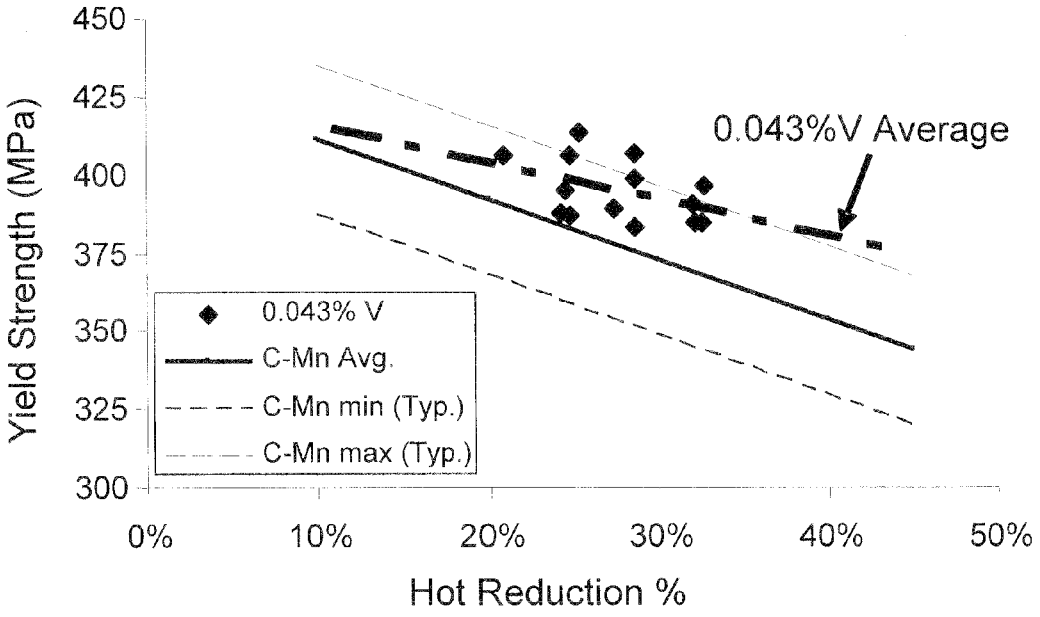
FIG. 26 is an additional graph showing the effect of hot rolling reduction on the yield strength for the present vanadium steel compared to plain low carbon steel.

The yield strength of steel H is shown in FIGS. 25 and 26. The yield strength results for the 0.04% vanadium (steel H) are compared to plain low carbon steel as a function of the hot rolling reduction in FIGS. 25 and 26. While the yield strength results are within the range for the plain carbon-manganese steel, the steel with vanadium addition was stronger in the hot rolled condition than the base steel. As shown in FIG. 26, the amount of hot rolling reduction of the vanadium microalloyed steel has less effect on the strength compared to the plain carbon base steel.

The yield strength of steel H in the as-hot rolled and galvanized conditions are presented in FIGS. 25 and 26. The vanadium steel achieved higher strength levels than the plain carbon base steel, even though it was produced using higher coiling temperatures. In the samples shown in FIGS. 25 and 26, the coiling temperature of steel H was 570° C., and the base steel coiling temperature was less than 500° C.

Figure 27A:
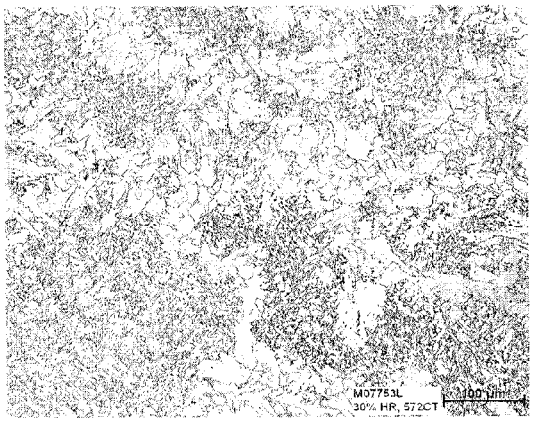
FIG. 27A is a micrograph of the microstructure of a sample of 0.04% vanadium steel after hot rolling.
Figure 27B:
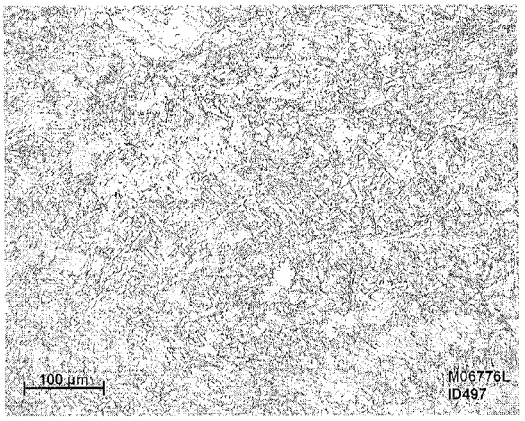
FIG. 27B is a micrograph of the microstructure of a sample of 0.024% vanadium steel after hot rolling.
Figure 28:
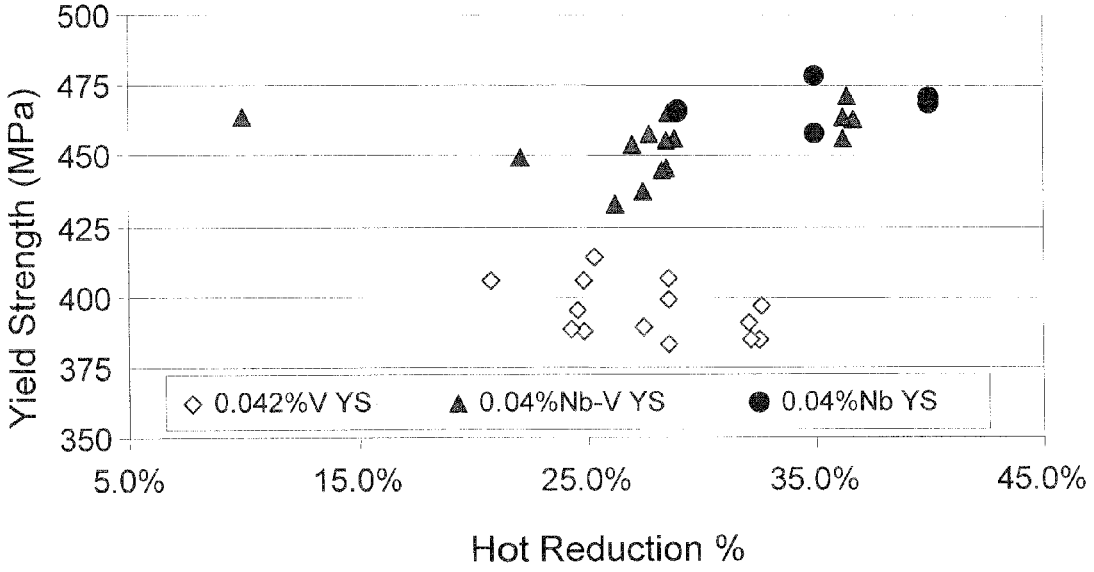
FIG. 28 shows a comparison of yield strengths of steel having additions of vanadium and/or niobium.
Figure 29:
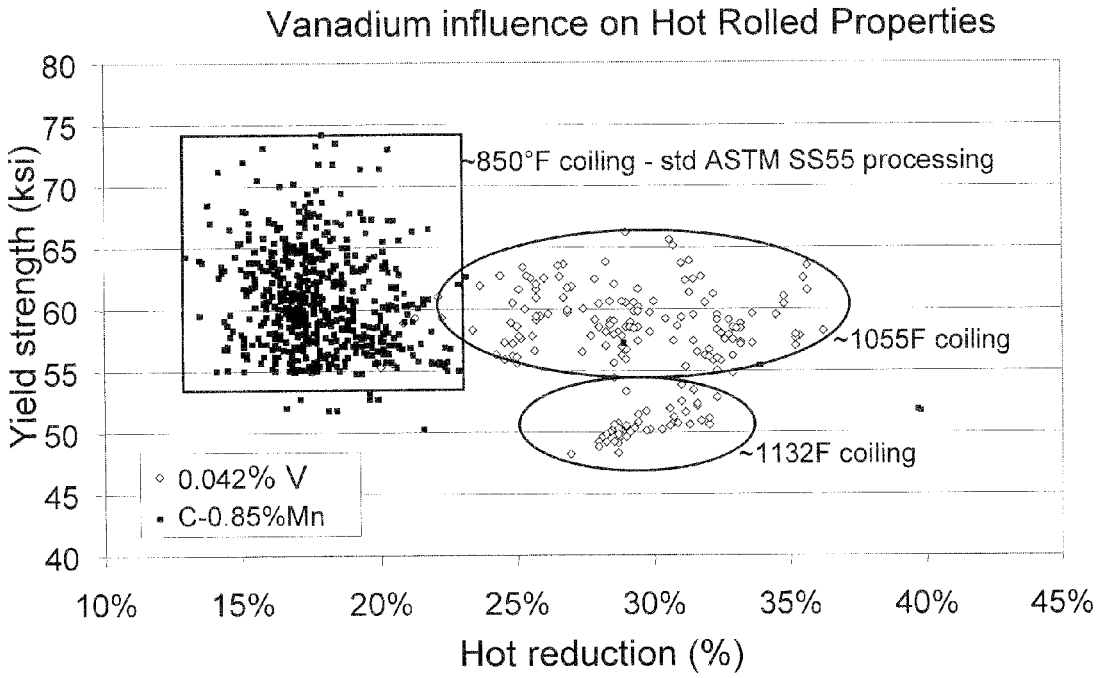
FIG. 29 is a chart showing the effect of coiling temperature and hot rolling reduction on yield strength of vanadium steel.

The microstructure of 0.04% vanadium (steel H), coiled at about 570° C., is shown in FIG. 27A. The microstructure of the 0.04% vanadium steel is predominately grain boundary ferrite and acicular ferrite, similar to the microstructure of the plain carbon base steel produced with a similar coiling temperature (see FIG. 4B, coiled at less than 500° C.). In comparison, the microstructure of 0.024% niobium steel, also coiled at about 570° C., is shown in FIG. 27B. The addition of vanadium did increase the hardenability of the steel but not as much as niobium without vanadium. As shown in FIG. 27B, the formation of grain boundary ferrite was completely suppressed by the 0.024% niobium addition, resulting in a final microstructure of bainite and acicular ferrite. The 0.04% vanadium steel (steel H) shown in FIG. 27A includes polygonal ferrite at prior austenite grain boundaries. The yield strength of steel H is compared to 0.04% niobium steel in FIG. 28. As shown in FIG. 28, higher strength levels were achieved with the 0.04% niobium than the 0.04% vanadium steel. In FIG. 29, the effect of coiling temperature and hot roll reduction is shown for the 0.04% vanadium steel.

In another embodiment, 0.04% niobium and 0.04% vanadium were provided in steel I. The yield strength of steel I is compared to the 0.04% vanadium steel (steel H) and 0.04% niobium steel (steel D). The strength levels recorded for the 0.04% niobium steel and the 0.04% Nb+0.04% V steel were very similar in the hot rolled condition.

The amount of nitrogen in the molten steel with vanadium may be controlled to provide less nitrogen than in prior vanadium steels. In the past, the vanadium to nitrogen ratio was less than 4:1 to provide an excess of nitrogen over a stoichiometric combination of vanadium and nitrogen. In the present vanadium steels, the ratio of vanadium to nitrogen content may be greater than 4:1 by weight. Alternatively or in addition, the ratio of vanadium to nitrogen content may be between 4:1 and 7:1.

Figure 24:
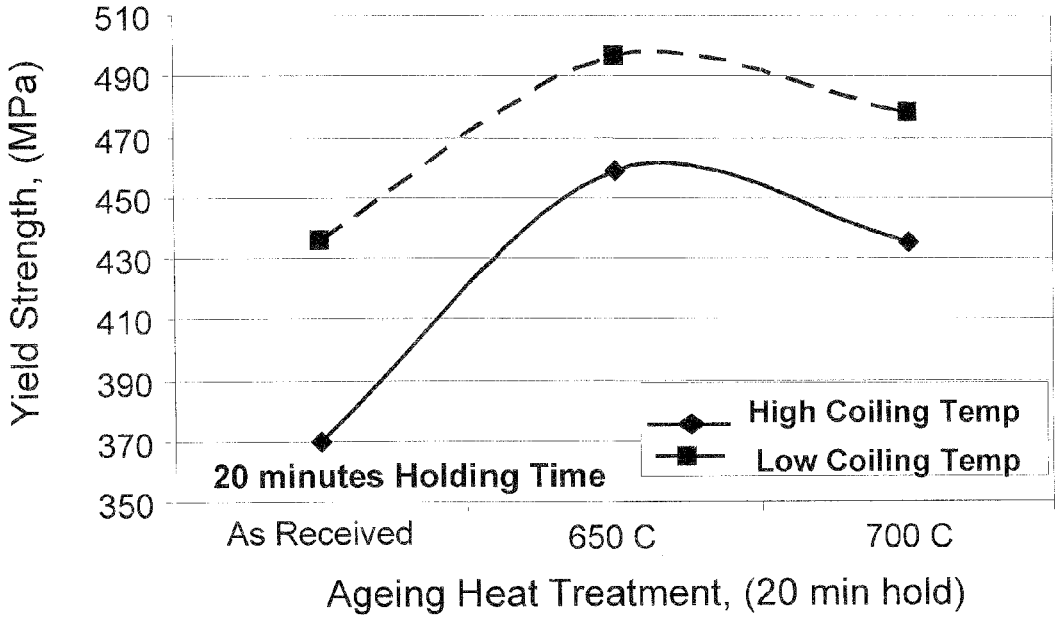
FIG. 24 is a graph showing the effect of heat treating on the yield strength for the present vanadium steel.

The 0.04% vanadium steel (steel H) was produced with two different coiling temperatures, and was subsequently aged for 20 minutes at 650° C. and 700° C. to induce hardening by vanadium in solid solution. The results show that significant strengthening was achieved from these heat treatment conditions. The strengthening increment was slightly higher for the material produced with the higher coiling temperature as shown in FIG. 24, which may be due to the microstructural tempering at the lower coiling temperature. The strengthening increment realized with the material produced at the lower coiling temperature was of the same order of that achieved with the 0.026% Nb steel.

Also shown in FIG. 25, a strength increase was realized in the vanadium steel (steel H) from an age hardening using the annealing furnaces on a continuous galvanising line. A strength increment of about 50 MPa was provided, but the strength increase was less than was realized from an equivalent niobium content. The yield strength of the sample in FIG. 25 on the galvanizing line was about 450 MPa in the galvanized condition, which is in the order achieved with the longer term laboratory heat treatments shown in FIG. 24. The strength of the vanadium steel may be more sensitive to coiling temperature than the niobium steels.

TABLE 4

| Steel | Condition. | Y.S. (MPa) | T.S. (MPa) | T. Elong. % | T.S./ Y.S. |
|---|---|---|---|---|---|
| 0.04% V (steel H) | HR | 393.1 | 493.2 | 20.6 | 1.254 |
| 0.04% V (steel H) | Galv | 445.6 | 534.1 | 18.3 | 1.199 |
| 0.04% Nb (steel D) | Galv | 527.6 | 596.2 | 16.9 | 1.130 |
| 0.04% Nb + 0.04% V (I) | Galv | 530.1 | 624.6 | 14.1 | 1.178 |

Figure 30:
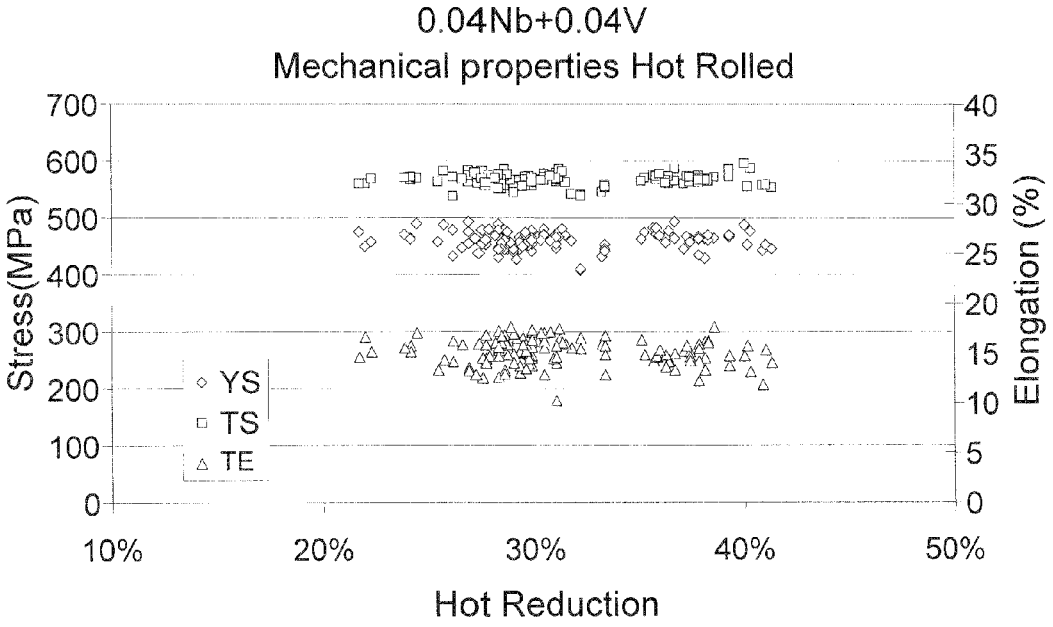
FIG. 30 is a graph showing the effect of hot rolling reduction on the yield strength, tensile strength, and total elongation for 0.04Nb+0.04V steel in the hot rolled condition.
Figure 31:
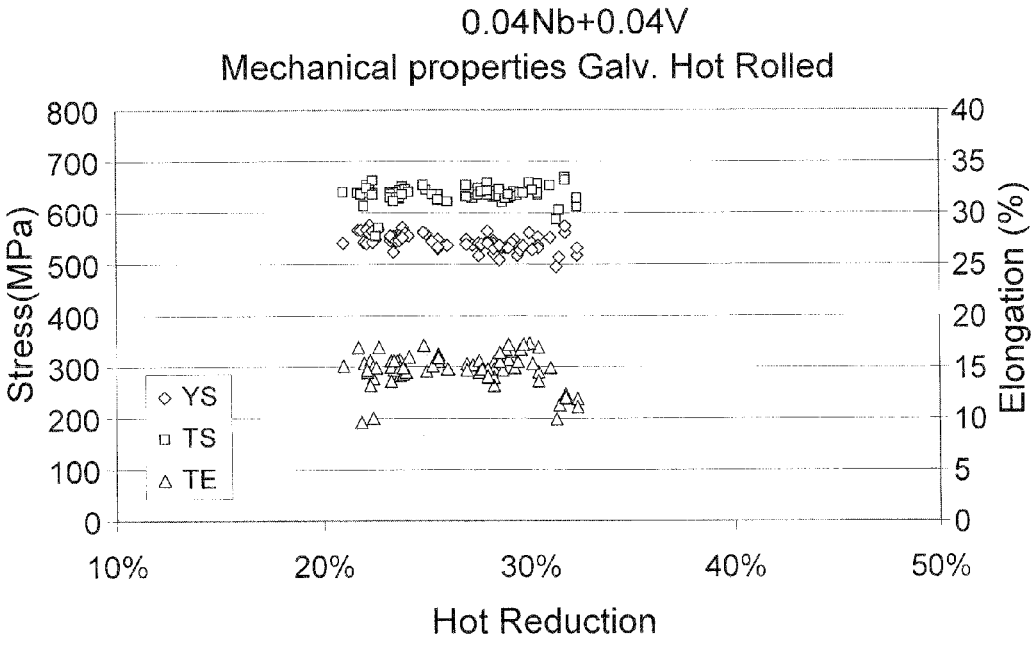
FIG. 31 is a graph showing the effect of hot rolling reduction on the yield strength, tensile strength, and total elongation for 0.04Nb+0.04V steel in the hot rolled and galvanized condition.

The tensile strength and elongation properties for the 0.04% Nb+0.04% V steel (steel I) similarly processed on continuous galvanising line are included in TABLE 4, as well as the typical properties for the 0.04% niobium steel (steel D) and 0.04% vanadium steel (steel I) for comparative purposes. The 0.04% Nb+0.04% V steel had a slightly higher strength than the 0.041% Nb steel in the age hardened and galvanized condition. As steels D and I had similar strengths in the as-hot rolled condition (see FIG. 28), these initial experiments indicate that the strengthening increment from age hardening the dual Nb+V microalloyed system may be less than what would be realized if the strength increment was simply the cumulative increment of the individual microalloying elements. However, as shown in FIGS. 30 and 31, the strength levels of the 0.04% Nb+0.04% V steel were largely insensitive to the degree of hot rolling.

Figure 32:
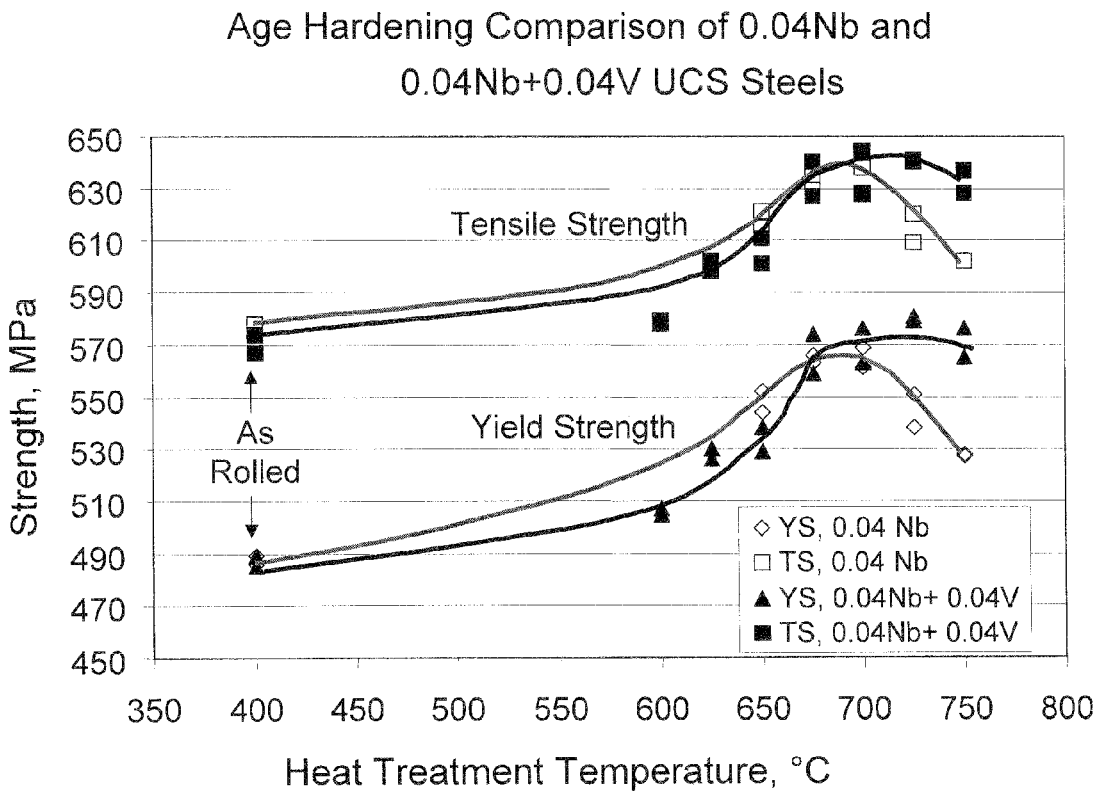
FIG. 32 is a comparison of effect of age hardening on 0.04% niobium and 0.04Nb+0.04V steels.

The combination of niobium with another alloy such as vanadium provides a significant improvement in the age hardening process. By tailoring the composition to provide niobium with vanadium, desired mechanical properties are obtained using a wider range of age hardening temperatures. As shown in FIG. 32, with niobium steel the desired properties are provided using age hardening temperatures between about 675° C. and 700° C. By combining niobium and vanadium, we are able to use age hardening temperatures between about 670° C. and about 750° C. to obtain the desired properties. The variation in yield strength and tensile strength may be within 10% measured at three temperatures within a 50° C. age hardening temperature range. Alternatively, the variation in yield strength and tensile strength may be within 10% measured at three temperatures within a 75° C. age hardening temperature range. The increased window of temperature provides greater flexibility in processing parameters enabling greater efficiency.

As discussed above, steels for certain cold formed structural sections such as used in residential framing, require a total elongation of at least 10% and a tensile strength to yield strength ratio of at least 1.08. In prior hot dip coated steel products with strip thicknesses less than about 1.6 mm, such requirements could not be achieved using full hard cold rolled material. The present steel product hot dip coated and in the range of about 0.9 to 1.5 mm has high strength levels with excellent ductility using age hardening during continuous hot dip galvanizing, as previously discussed. For coated sheet thickness in the range of about 0.70 to 0.9 mm, however, cold recovery annealing may be used as discussed below.

Figure 33:
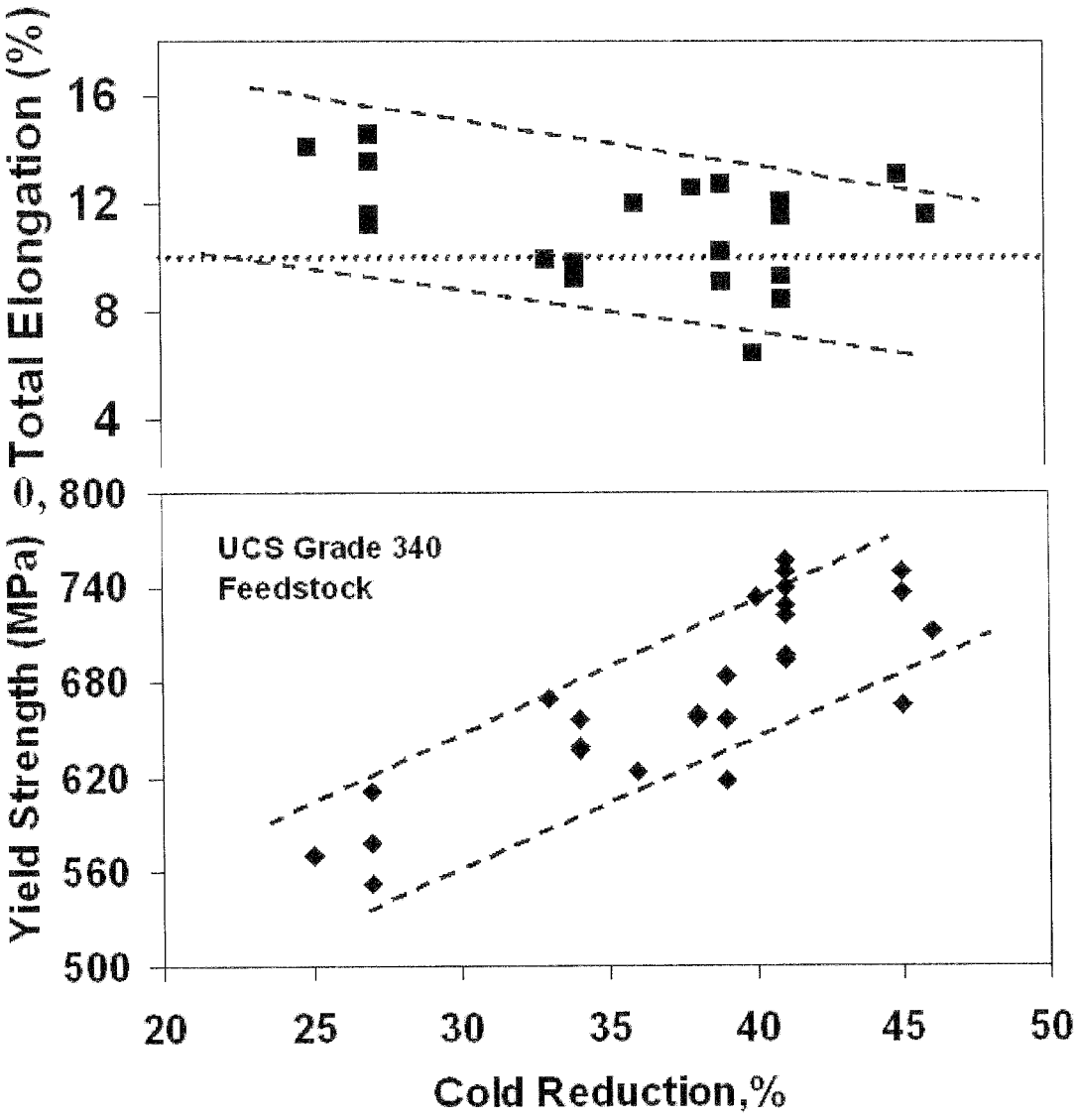
FIG. 33 is a graph showing the effect of cold reduction on properties of plain carbon-manganese steel.

High strength products with high ductility properties may be provided using cold rolling and subsequent recovery annealing. Using low levels of cold reduction to the final thickness improves the final recovery annealed ductility. For example, the effect of cold reduction on strength and elongation of galvanized plain carbon-manganese steel in the recovery annealed condition is shown in FIG. 33. The present niobium microalloyed steel provides high strength in the hot rolled condition allowing high strength levels in the recovery annealed condition with limited cold reduction. Additionally, the present steel has a high recrystallization temperature and very fine inclusions as discussed above. We have found the combination of low cold reduction levels and high recrystallization temperature allows relatively high recovery annealing temperatures to be applied, which aids the final ductility and provides a robust recovery annealing temperature range. A small niobium addition (~0.015% Nb) expands the recovery annealing temperature range and enables the improvement of properties by age hardening, as discussed previously.

TABLE 5

| Grade | Yield Strength (MPa) | Tensile Strength (MPa) | Tensile Strength/Yield Strength | Total Elongation % |
|---|---|---|---|---|
| C—Mn #1 | 549.1 | 606.3 | 1.11 | 14.2 |
| C—Mn #2 | 530.5 | 581.5 | 1.11 | 14.4 |
| 0.015% Nb | 593.2 | 650.4 | 1.10 | 13.1 |
| Target | ≥490 | * | ≥1.08 | ≥10% |

* minimum tensile strength dependant on produced yield strength.

The resultant tensile properties for 0.75 mm strip produced from plain carbon steel, samples #1 and #2, and 0.015% Nb microalloyed steel in the recovery annealed condition are shown in TABLE 5. Each of the samples exceeds the ductility requirements for structural steels in the building codes (Target). The niobium microalloyed steel provided improved strength and ductility over the plain carbon steel, with yield strengths in excess of 550 MPa and elongation greater than 13%. The present niobium steel in the cold rolled and recovery annealed condition provide a high strength, light gauge, coated strip product with sufficient ductility for cold formed structural steels.

Figure 34:
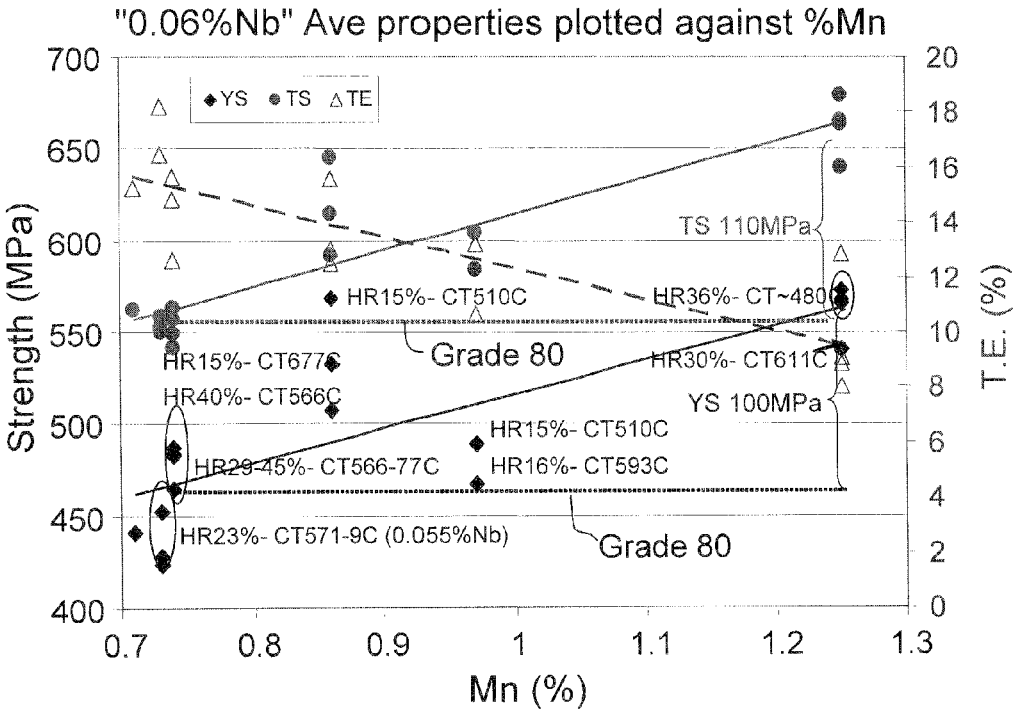
FIG. 34 is a graph showing the effect of manganese addition on the strength and elongation of 0.06% niobium steel.
Figure 35:
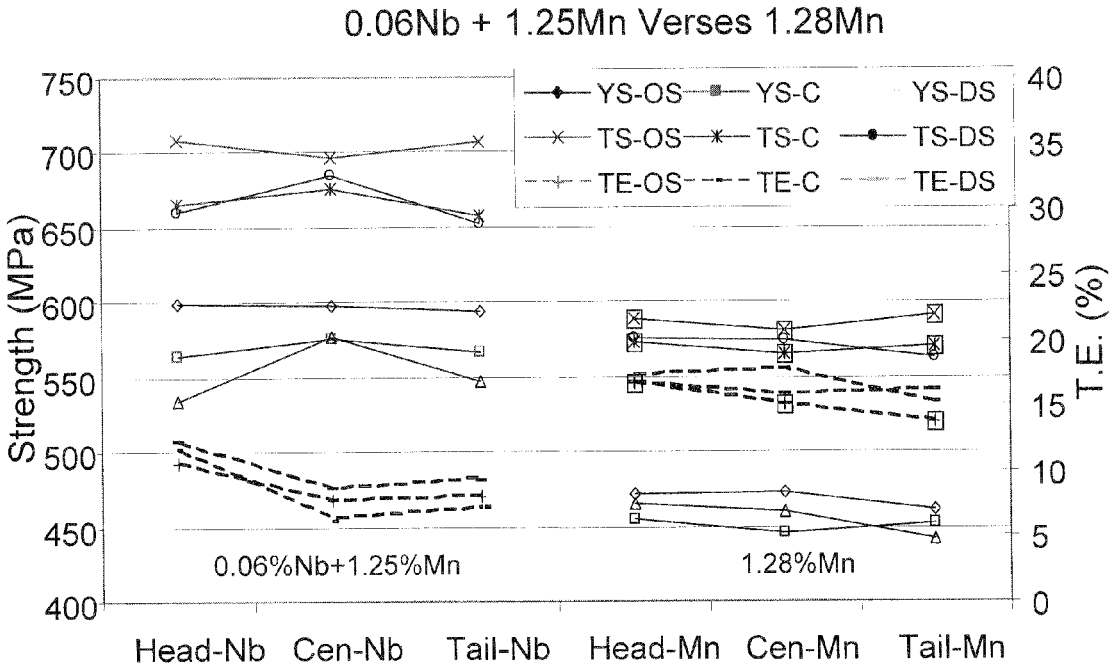
FIG. 35 is a graph showing the strength and elongation of elevated manganese levels and 0.06% niobium.

Alternatively, increases in strength may be obtained using the combination of niobium with manganese. As shown in FIGS. 34 and 35, the addition of elevated manganese, such as about 1.25%, increases strength significantly higher than elevated manganese without niobium, and is also higher strength than niobium with lower levels of manganese, such as steels E and F in Table 2 above. The amount of manganese may be between about 1.0% and 2.0% by weight. Alternatively, the amount of manganese may be between about 1.0% and 1.3%. As shown in FIG. 34, the 0.06% niobium steel exceeds the tensile and yield strength requirements for Grade 80 with levels of manganese between 1.0% and 1.3%.

TABLE 6

| Steel | Mn | Nb | Coil Temp ° C. | Tensile Strength |
|---|---|---|---|---|
| 0.06Nb + 1.25Mn | 1.25 | 0.06 | 485 | 675 |
| C—Mn #3 | 1.28 | <0.003 | 518 | 565 |

Alternatively, increases in strength may be obtained using the combination of niobium with copper. We have found that the desired hardenability may be obtained from copper above about 0.2%, and may be up to about 0.6% copper by weight. Alternatively, the copper may be between about 0.3% and 0.4%.

This thin cast strip enables production of new steel product types including:

1. A high strength, light gauge, galvanized strip by utilizing a microstructure that has bainite as the major constituent and age hardening during the galvanizing process. The annealing section of the galvanizing line can be used to induce age hardening of the niobium and/or vanadium of the thin cast strip that has been hot rolled.

2. A high strength, light gauge, uncoated strip by utilizing a microstructure that is majority bainite and age hardened during processing on a continuous annealing line. The high temperature furnace of the conventional continuous annealing can be used to induce activation of the niobium and vanadium elements retained in solid solution by the bainite microstructure after hot rolling of the thin cast strip.

3. A high strength, light gauge, hot rolled cast strip product where the strength levels are insensitive to the degree of hot rolling reduction applied. The bainitic microstructure produces a relatively high strength product (YS≥380 MPa (~55 ksi)). The suppression of austenite recrystallization during or after hot rolling can provide final strength levels insensitive to the degree of hot rolling reduction. The final strength levels will be consistent across a range of thicknesses that can be produced by a thin cast strip process.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A method of preparing coiled thin cast steel strip comprising the steps of:

assembling an internally cooled roll caster having laterally positioned casting rolls forming a nip between them, and forming a casting pool of molten steel supported on the casting rolls above the nip and confined adjacent the ends of the casting rolls by side dams, the molten steel having a free oxygen content between 20 and 70 ppm, counter rotating the casting rolls to solidify metal shells on the casting rolls as the casting rolls move through the casting pool, forming from the metal shells downwardly through the nip between the casting rolls a steel strip having a composition comprising by weight, less than 0.25% carbon, between 0.20 and 2.0% manganese, between 0.05 and 0.50% silicon, less than 0.01% aluminum, and at least one element selected from the group consisting of niobium between about 0.01% and about 0.20%, vanadium between about 0.01% and about 0.20%, and a mixture thereof, with nitrogen present, wherein, if vanadium is present, vanadium is present with nitrogen satisfying a ratio of vanadium to nitrogen content between 4:1 and 7:1 by weight, the nitrogen aiding in keeping the at least one of niobium, vanadium, and the mixture thereof in solid solution, and cooling the steel strip at a rate of at least 10° C. per second to provide a majority of the microstructure comprised of bainite and acicular ferrite and having more than 70% niobium and/or vanadium in solid solution and a tensile strength to yield strength ratio of at least 1.08.

2. The method of preparing coiled thin cast steel strip as claimed in claim 1 where the steel strip as coiled has fine oxide particles of silicon and iron distributed through the steel microstructure having an average particle size less than 50 nanometers.

3. The method of preparing coiled thin cast steel strip as claimed in claim 1 further comprising the steps of:

hot rolling the steel strip; and coiling the hot rolled steel strip at a temperature between about 450 and 700° C.

4. The method of preparing coiled thin cast steel strip as claimed in claim 1 further comprising the steps of:

hot rolling the steel strip; and coiling the hot rolled steel strip at a temperature less than 650° C.

5. The method of preparing coiled thin cast steel strip as claimed in claim 1 further comprising the step of:

age hardening the steel strip to increase the tensile strength at a temperature of at least 550° C.

6. The method of preparing coiled thin cast steel strip as claimed in claim 5 further comprising the step of:

hot dip coating the steel strip to provide a coating of zinc or a zinc alloy.

7. A method of preparing a thin cast steel strip comprising the steps of:

assembling an internally cooled roll caster having laterally positioned casting rolls forming a nip between them, and forming a casting pool of molten steel supported on the casting rolls above the nip and confined adjacent the ends of the casting rolls by side dams, the molten steel having a free oxygen content between 20 and 70 ppm, counter rotating the casting rolls to solidify metal shells on the casting rolls as the casting rolls move through the casting pool, forming steel strip from the metal shells cast downwardly through the nip between the casting rolls having a composition comprising by weight, less than 0.25% carbon, less than 0.01% aluminum, and at least one element from the group consisting of niobium between about 0.01% and about 0.20%, vanadium between about 0.01% and about 0.20%, and a mixture thereof, with nitrogen present, wherein, if vanadium is present, vanadium is present with nitrogen satisfying a ratio of vanadium to nitrogen content between 4:1 and 7:1 by weight, the nitrogen aiding in keeping the at least one of niobium, vanadium, and the mixture thereof in solid solution, cooling the steel strip at a rate of at least 10° C. per second to provide a majority of the microstructure comprising bainite and acicular ferrite and having more than 70% niobium and/or vanadium in solid solution, cold rolling the steel strip with a cold reduction between about 10 and 35%, and age hardening the steel strip at a temperature between 625° C. and 800° C.

8. The method of preparing a thin cast steel strip as claimed in claim 7 where the age hardening step includes:

hot dip coating the steel strip to provide a coating of zinc or a zinc alloy.

9. The method of preparing a thin cast steel strip as claimed in claim 7 where the age hardened steel strip has niobium carbonitride particles with an average particle size of 10 nanometers and less.

10. The method of preparing a thin cast steel strip as claimed in claim 7 where the age hardened steel strip has substantially no niobium carbonitride particles greater than 50 nanometers.

11. The method of preparing a thin cast steel strip as claimed in claim 7 where the steel strip as coiled has fine oxide particles of silicon and iron distributed through the steel microstructure having an average particle size less than 50 nanometers.

12. The method of preparing a thin cast steel strip as claimed in claim 7 further comprising the steps of:

hot rolling the steel strip; and coiling the hot rolled steel strip at a temperature less than 700° C.

13. The method of preparing a thin cast steel strip as claimed in claim 7 further comprising the steps of:

hot rolling the steel strip; and coiling the hot rolled steel strip at a temperature less than 650° C.

14. The method of preparing a thin cast steel strip as claimed in claim 7 where the step of age hardening the steel strip to increase the tensile strength.

15. The method of preparing a thin cast steel strip as claimed in claim 7 where the step of age hardening occurs at a temperature between 650° C. and 750° C.

16. A method of preparing a thin cast steel strip comprising the steps of:

assembling an internally cooled roll caster having laterally positioned casting rolls forming a nip between them, and forming a casting pool of molten steel supported on the casting rolls above the nip and confined adjacent the ends of the casting rolls by side dams, the molten steel having a free oxygen content between 20 and 70 ppm, counter rotating the casting rolls to solidify metal shells on the casting rolls as the casting rolls move through the casting pool, forming from the metal shells downwardly through the nip between the casting rolls a steel strip having a composition comprising by weight, less than 0.25% carbon, between 0.20 and 2.0% manganese, between 0.05 and 0.50% silicon, less than 0.01% aluminum, and at least one element from the group consisting of niobium between about 0.01% and about 0.20%, vanadium between about 0.01% and about 0.20%, and a mixture thereof, with nitrogen present, wherein, if vanadium is present, vanadium is present with nitrogen satisfying a ratio of vanadium to nitrogen content between 4:1 and 7:1 by weight, the nitrogen aiding in keeping the at least one of niobium, vanadium, and the mixture thereof in solid solution, cooling the steel strip at a rate of at least 10° C. per second to provide a majority of the microstructure comprised of bainite and acicular ferrite, cold rolling the steel strip with a cold reduction between about 10 and 35%, and age hardening the steel strip at a temperature between 625° C. and 800° C. and having an increase in elongation and an increase in yield strength after age hardening.

17. The method of preparing a thin cast steel strip as claimed in claim 16 where the age hardening step includes:

hot dip coating the steel strip to provide a coating of zinc or a zinc alloy.

18. The method of preparing a thin cast steel strip as claimed in claim 16 where the steel strip as coiled has fine oxide particles of silicon and iron distributed through the steel microstructure having an average particle size less than 50 nanometers.

19. The method of preparing a thin cast steel strip as claimed in claim 16 where the age hardened steel strip has niobium carbonitride particles with an average particle size of 10 nanometers and less.

20. The method of preparing a thin cast steel strip as claimed in claim 16 where the age hardened steel strip has substantially no niobium carbonitride particles greater than 50 nanometers.

21. The method of preparing a thin cast steel strip as claimed in claim 16 further comprising the steps of:

hot rolling the steel strip; and coiling the hot rolled steel strip at a temperature less than 750° C.

22. The method of preparing a thin cast steel strip as claimed in claim 16 further comprising the steps of:

hot rolling the steel strip; and coiling the hot rolled steel strip at a temperature less than 700° C.

23. The method of preparing coiled thin cast steel strip as claimed in claim 16 further comprising the steps of:

hot rolling the steel strip; and coiling the hot rolled steel strip at a temperature less than 600° C.

24. The method of preparing coiled thin cast steel strip as claimed in claim 16 where the age hardening step includes:

hot dip coating the steel strip to provide a coating of zinc or a zinc alloy.

25. The method of preparing coiled thin cast steel strip as claimed in claim 16 where the age hardening step includes:

age hardening at a temperature between 650° C. and 750° C.

26. A method of preparing a thin cast steel strip comprising the steps of:

assembling internally a cooled roll caster having laterally positioned casting rolls forming a nip between them, and forming a casting pool of molten low carbon steel supported on the casting rolls above the nip and confined adjacent the ends of the casting rolls by side dams, the molten steel having a free oxygen content between 20 and 70 ppm, counter rotating the casting rolls to solidify metal shells on the casting rolls as the rolls move through the casting pool;

forming from the metal shells downwardly through the nip between the casting rolls a steel strip;

cooling the steel strip at a rate of 10° C. per second and above to provide a composition comprising by weight, less than 0.25% carbon, between 0.20 and 2.0% manganese, between 0.05 and 0.50% silicon, less than 0.01% aluminum, and at least one element selected from the group consisting of niobium between about 0.01% and about 0.20%, vanadium between about 0.01% and about 0.02%, and a mixture thereof, with nitrogen present, wherein, if vanadium is present, vanadium is present with nitrogen satisfying a ratio of vanadium to nitrogen content between 4:1 and 7:1 by weight, the nitrogen aiding in keeping the at least one of niobium, vanadium, and the mixture thereof in solid solution, and the steel strip having a microstructure with a majority comprised of bainite and a yield strength of at least 55 ksi (380 MPa).

27. The method of preparing a thin cast steel strip as claimed in claim 26, further comprising the step of:

coiling the steel strip, the coiled steel strip having fine oxide particles of silicon and iron distributed through the steel microstructure having an average precipitate size less than 50 nanometers.

28. The method of preparing a thin cast steel strip as claimed in claim 26 further comprising the step of:

hot rolling the low carbon steel strip; and where the step of coiling the steel strip comprises coiling the hot rolled low carbon steel strip at a temperature in the range from about 500-700° C.

29. The method of preparing a thin cast steel strip as claimed in claim 28 further comprising the step of:

precipitation hardening the low carbon steel strip to increase the tensile strength at a temperature of at least 550° C.

30. The method of preparing a thin cast steel strip as claimed in claim 28 further comprising the step of:

precipitation hardening at a temperature between 650° C. and 800° C.

31. The method of preparing a thin cast steel strip as claimed in claim 28 further comprising the step of:

precipitation hardening at a temperature between 675° C. and 750° C.

32. The method of preparing a thin cast steel strip as claimed in claim 26 wherein the steel strip has a total elongation between at least 6% and 18%.

33. The method of preparing a thin cast steel strip as claimed in claim 26 wherein the steel strip has a tensile strength of at least 72 ksi (500 MPa).

34. A method of preparing a thin cast steel strip comprising the steps of:

assembling internally a cooled roll caster having laterally positioned casting rolls forming a nip between them, and forming a casting pool of molten low carbon steel supported on the casting rolls above the nip and confined adjacent the ends of the casting rolls by side dams, the molten steel having a free oxygen content between 20 and 70 ppm, counter rotating the casting rolls to solidify metal shells on the casting rolls as the rolls move through the casting pool;

forming from the metal shells downwardly through the nip between the casting rolls a steel strip;

cooling the steel strip at a rate of 10° C. per second and above to provide a composition comprising by weight, less than 0.25% carbon, between 0.20 and 2.0% manganese, between 0.05 and 0.50% silicon, less than 0.01% aluminum, and at least one element selected from the group consisting of niobium between about 0.01% and about 0.20%, vanadium between about 0.01% and about 0.02%, and a mixture thereof, with nitrogen present, wherein, if vanadium is present, vanadium is present with nitrogen satisfying a ratio of vanadium to nitrogen content between 4:1 and 7:1 by weight, the nitrogen aiding in keeping the at least one of niobium, vanadium, and the mixture thereof in solid solution, and the steel strip having a microstructure with a majority comprised of bainite and a total elongation between at least 6% and 18%.

35. The method of preparing a thin cast steel strip as claimed in claim 34 further comprising the step of:

coiling the steel strip, the coiled steel strip having fine oxide particles of silicon and iron distributed through the steel microstructure having an average precipitate size less than 50 nanometers.

36. The method of preparing a thin cast steel strip as claimed in claim 34 further comprising the step of:

hot rolling the low carbon steel strip; and where the step of coiling the steel strip comprises coiling the hot rolled low carbon steel strip at a temperature in the range from about 500-700° C.

37. The method of preparing a thin cast steel strip as claimed in claim 34 further comprising the step of:

precipitation hardening the low carbon steel strip to increase the tensile strength at a temperature of at least 550° C.

38. The method of preparing a thin cast steel strip as claimed in claim 34 further comprising the step of:

precipitation hardening at a temperature between 650° C. and 800° C.

39. The method of preparing a thin cast steel strip as claimed in claim 34 further comprising the step of:

precipitation hardening at a temperature between 675° C. and 750° C.

40. The method of preparing a thin cast steel strip as claimed in claim 34 wherein the steel strip has a total elongation between at least 10% and 18%.

41. The method of preparing a thin cast steel strip as claimed in claim 34 wherein the steel strip has a yield strength of at least 55 ksi (380 MPa).

42. The method of preparing a thin cast steel strip as claimed in claim 34 wherein the steel strip has a tensile strength of at least 72 ksi (500 MPa).

* * * * *